US010144241B2

(12) United States Patent
Emmott et al.

(10) Patent No.: US 10,144,241 B2
(45) Date of Patent: Dec. 4, 2018

(54) SEPARABLE OR OPENING PORTIONS FOR PRINTABLE SHEET MATERIAL

(71) Applicants: Charles E. Emmott, Houston, TX (US); Gary G. Emmott, Houston, TX (US)

(72) Inventors: Charles E. Emmott, Houston, TX (US); Gary G. Emmott, Houston, TX (US)

( * ) Notice: Subject to any disclaimer, the term of this patent is extended or adjusted under 35 U.S.C. 154(b) by 0 days.

(21) Appl. No.: 15/241,594

(22) Filed: Aug. 19, 2016

(65) Prior Publication Data

US 2018/0050842 A1 Feb. 22, 2018

(51) Int. Cl.
*B42D 1/00* (2006.01)

(52) U.S. Cl.
CPC ..... *B42D 1/00* (2013.01)

(58) Field of Classification Search
CPC ..... B65D 27/34; B65D 27/06; B42D 1/00
USPC ..... 229/87.05; 428/43
See application file for complete search history.

(56) References Cited

U.S. PATENT DOCUMENTS

| | | | | |
|---|---|---|---|---|
| 2,266,958 | A | 12/1941 | Corbin | |
| 2,828,065 | A | 3/1958 | Heywood | |
| 3,036,755 | A | 5/1962 | Stone | |
| 3,110,434 | A | 11/1963 | Raymond et al. | |
| 3,322,329 | A | 5/1967 | Castaneda et al. | |
| 3,420,432 | A | 1/1969 | Cooper | |
| 3,464,621 | A | 9/1969 | Day | |
| 3,829,006 | A | 8/1974 | Spiegel | |
| 4,008,849 | A * | 2/1977 | Baber | B65D 5/54 229/235 |
| 4,204,600 | A | 5/1980 | Pritchard | |
| 4,497,433 | A | 2/1985 | Wischusen, III | |
| 4,550,834 | A | 11/1985 | Fletcher | |
| 4,676,430 | A | 6/1987 | Wischusen, III | |
| 4,963,406 | A | 10/1990 | Gooding, Jr. et al. | |
| 5,198,276 | A | 3/1993 | Nakajima | |
| 5,944,355 | A | 8/1999 | Rich et al. | |

(Continued)

FOREIGN PATENT DOCUMENTS

| | | | |
|---|---|---|---|
| JP | 08324597 | A * | 12/1996 |
| JP | 09095358 | A | 4/1997 |

(Continued)

OTHER PUBLICATIONS

Machine translation of the description of JP 2001-143263 (Okada et al.).*

(Continued)

*Primary Examiner* — Jes F Pascua
(74) *Attorney, Agent, or Firm* — William J. Clemens; Shumaker, Loop & Kendrick, LLP

(57) ABSTRACT

A printable sheet material includes a panel having an integral separable portion and a starting mechanism formed on the separable portion. At least two tearable lines are formed in the panel permitting the separable portion to be at least partially separated from a remaining portion of the panel by tearing in either of opposite directions. Each tearable line includes a plurality of open "V" channeling cuts spaced along the line, each of the channeling cuts formed by a pair of converging cuts having a wider spaced end and a narrower spaced end. The channeling cuts are oriented with the wider spaced ends facing toward the starting mechanism and the narrower spaced ends pointed in a tearing direction extending away from the starting mechanism. The channeling cuts of the two lines share one of the converging cuts.

6 Claims, 20 Drawing Sheets

(56) References Cited

U.S. PATENT DOCUMENTS

| | | | | |
|---|---|---|---|---|
| 7,066,321 | B2 | 6/2006 | Kawaguchi et al. | |
| 7,138,169 | B2 * | 11/2006 | Shiota | B29D 7/01 428/134 |
| 8,020,751 | B1 | 9/2011 | Emmott | |
| 8,413,801 | B2 * | 4/2013 | Justice | B65D 5/321 206/215 |
| 8,550,333 | B2 | 10/2013 | Emmott | |
| 8,714,437 | B2 | 5/2014 | Emmott | |
| 9,278,783 | B2 | 3/2016 | Emmott | |
| 2005/0184140 | A1 | 8/2005 | DeLa Vergne | |
| 2006/0231605 | A1 | 10/2006 | Collins | |
| 2008/0237070 | A1 | 10/2008 | Justice | |
| 2010/0230481 | A1 | 9/2010 | Emmott | |
| 2011/0024488 | A1 | 2/2011 | Rosen et al. | |

FOREIGN PATENT DOCUMENTS

| | | | | |
|---|---|---|---|---|
| JP | 11310270 | A | * | 11/1999 |
| JP | 2000007016 | A | * | 1/2000 |
| JP | 2001097396 | A | * | 4/2001 |
| JP | 2001146263 | A | | 5/2001 |
| JP | 2001151246 | A | * | 6/2001 |
| JP | 2002255230 | A | | 9/2002 |
| JP | 2008018970 | A | * | 1/2008 |
| JP | 2008105719 | A | | 5/2008 |
| JP | 2008154902 | A | * | 7/2008 |
| JP | 2009046204 | A | * | 3/2009 |
| JP | 2010029975 | A | | 2/2010 |
| JP | 2010030628 | A | | 2/2010 |
| JP | 2010260592 | A | | 11/2010 |
| JP | 2014061942 | A | * | 4/2014 |
| JP | 2014166882 | A | * | 9/2014 |

OTHER PUBLICATIONS

Machine translation of the description of JP 8-324597 (Endo et al.).*

* cited by examiner

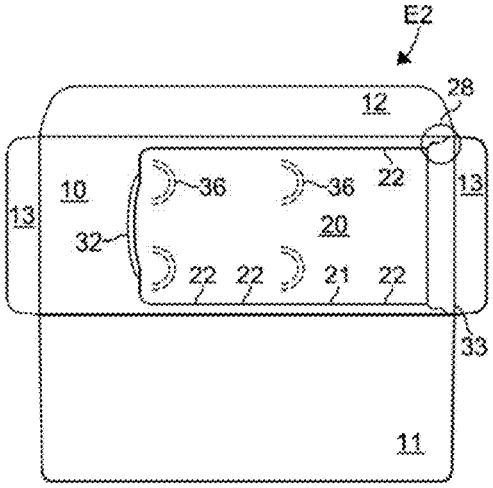
FIG. 3A
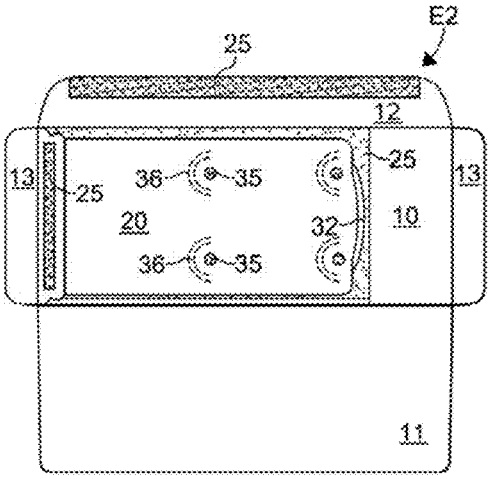
FIG. 3C
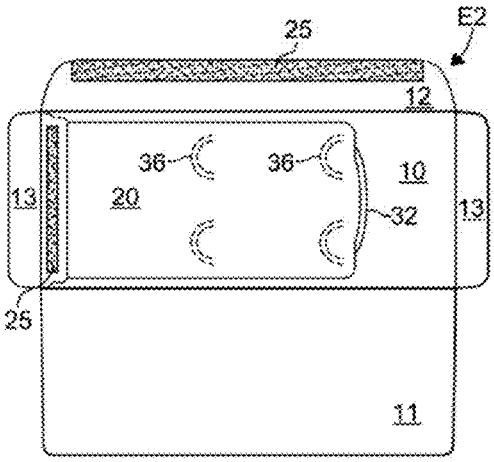
FIG. 3B
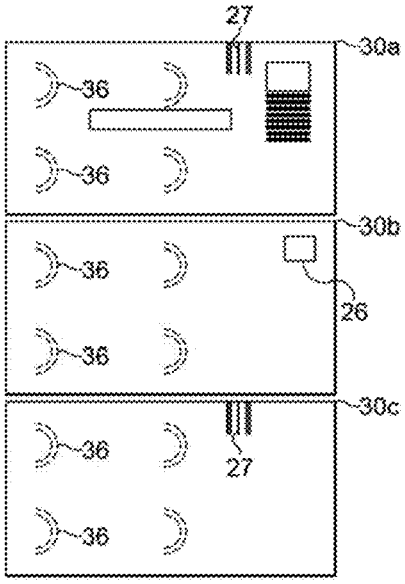

SEPARABLE OR OPENING PORTIONS FOR PRINTABLE SHEET MATERIAL

CROSS-REFERENCE TO RELATED APPLICATION

This application is a continuation-in-part of the co-pending U.S. patent application Ser. No. 15/006,390, filed Jan. 26, 2016, that is a continuation of the U.S. patent application Ser. No. 14/208,010, filed Mar. 13, 2014, that issued as U.S. Pat. No. 9,278,783 on Mar. 8, 2016, that claims the benefit of U.S. provisional patent application Ser. No. 61/778,603 filed Mar. 13, 2013. U.S. patent application Ser. No. 14/208,010 is a continuation-in-part of the U.S. patent application Ser. No. 12/749,152 filed Mar. 29, 2010, that issued as U.S. Pat. No. 8,714,437 on May 6, 2014, that claims the benefit of U.S. provisional patent application Ser. No. 61/164,418 filed Mar. 28, 2009.

FIELD OF THE INVENTION

The invention relates to apparatus, articles of manufacture and methods relating to improved separable or opening portions or structures or at least partially separable portions or structures for printable sheet material.

BACKGROUND OF THE INVENTION

Many containers, such as envelopes, re-usable envelopes, carrier envelopes, pockets, cartons, food packaging, retail packaging and forms, such as single sheet forms, folded forms, folded mailers are formed of printable sheet material that is designed to incorporate at least a partially separable portion or portions that may be used to open the container, or expose or remove an area, or separate connected portions of the form or container portions. Generally the existing tearable cut designs and tear strips are weak because of the close linear spacing of the tearable line patterns that make the tearable line weak or they have curved or L-shaped cut patterns that catch on inserting or processing equipment or when handled by a person.

Other items that have one or more layers or panels of printable sheet material are postcards, single sheet advertisements and order forms that can also incorporate at least a partially separable portion or portions. Various problems and inefficiencies are associated with the opening or separation of these portions relative to the remaining sheet material. For example, unsealing or opening of the item is often difficult, messy or damaging to the item. The existing perforation (cut and connector designs do not ensure that the desired tearing path is followed. Depending on how someone grasps and pulls the two separating portions, variable forces are applied that can subsequently cause the tearing of the two separable portions to drift away or tear into adjacent areas at each gap or connector area where the cuts are spaced apart to form gaps called connectors that are necessary to provide strength for the connection of the two separable portions for manufacture and use. Attempts at solving the problems and inefficiencies associated with manufacturing, fastening and separating such items have proven unsatisfactory.

Accordingly, there exists a need for apparatus, methods and articles of manufacture for fastening and/or separating portions of sheet material having one or more of the following attributes, capabilities or features: allows for easy release, separation or opening of connected sheet material portions; limits, minimizes or eliminates damage to the portions being separated; reduces, limits, eliminates or controls tearing of the sheet material portions during separation; reduces, limits, eliminates or controls tearing of the portions during separation regardless of the direction of separation of the connected portions; reduces, limits, eliminates or controls tearing of the portions during separation when the connected portions are separated in a particular direction; indicates tampering or attempted opening of the connected portions; prevents or reduces damage to text or graphics included on any connected/separated portions; provides an intuitive mechanism for opening or separating connected portions; makes opening containers easier; provides simple, dependable, easy-open functionality for containers; preserves the appearance and/or integrity of connected portions after separation; provides desired sturdiness of affixation/separation mechanisms; eliminates the need for equipment to open certain containers or separate connected portions; enables re-use, resealing or remailing of sheet material and containers made from sheet material; prevents accidental opening of perforations on containers; allows for easy connection of container portions; removes or reduces uncertainty in determining the quantity and extent of affixation material to include on the portions to be connected; enables the manufacture, sealing and use of containers with less affixation material; simplifies the manufacturing process of containers and other sheet material items; removes or reduces potential difficulties in processing and/or handling sheet material items; and allows for easy use of sheet material item manufacturing and handling equipment, such as high-speed envelope printing and converting technology, envelope insertion and sealing equipment, and mail processing technologies.

SUMMARY OF THE INVENTION

As used herein, the term "invention" and variations thereof refer merely to at least one feature or capability that may be part of at least one embodiment of the invention, may be implemented and/or claimed independently, in combination with at least one other feature or capability, or not at all. The use of the term "invention" and variations thereof does not mean or refer to the subject matter of every embodiment of the invention or each and every claim, or necessarily any claims, of any patent application. Thus, the use herein of the term "invention" and variations thereof should not limit the scope of the invention or any claims of any patent application or patent related to, based upon or claiming priority to this application.

The invention includes various independent aspects or features. Included with this patent application are sample embodiments illustrated in drawings showing various views of various particular embodiments of the invention. The drawings are not necessarily to scale and certain features and certain views of the drawings may be shown exaggerated in scale or in schematic form in the interest of clarity and conciseness. Common or similar components or elements of the various illustrated embodiments are evident based upon the drawings themselves. Any text, graphics and other writings appearing in the drawings are provided only as examples of potential features that may be included in the illustrated embodiments, but which are not required by, or limiting upon, the invention.

The invention may have one or more of the features, capabilities or advantages described below or shown in the drawings and sample embodiments, as well as other features, capabilities and advantages that will be apparent to a person skilled in the art based upon the description below and/or the attached drawings. However, the invention is not limited to the embodiments described herein or shown in the attached drawings, or any particular details thereof. Also, any of the particular features described or shown with respect to one embodiment of the invention may be included in any other embodiment or application of the invention. Further, nothing in this document or the attached drawings or sample embodiments should limit the scope of the invention, or any patent claims of any patent applications relating hereto. This patent application is intended merely to provide a written description of examples of various features of the invention and the manner and process of making and using at least one embodiment sufficient to enable a person skilled in the art to make and use the invention, and to set forth the best mode presently contemplated by the inventor of carrying out the invention.

An object of the invention is to minimize the number of cuts to form at least one set of opposing controlled tearable pathways that ensure that the tearing follows the desired pathway and that can be adjusted to form at least one set of opposing tearable lines or sections or strips that can be utilized to open or access or view at least a portion of a container or package or its contents, or to remove at least a portion or section of a printable form or sheet. A second goal of the invention is to make it reliable for manufacture and use. Fewer cuts increases the strength and reliability of the opening pattern within the printable sheet or form and fewer cuts reduces the amount of surface pressure placed upon the die for die cutting the printable sheet or form. A starting mechanism can be incorporated with the shared cut opposing tearable pathway open "V" cut pattern to make it user friendly for the recipient and reliable for handling, insertion, fulfillment or machine processing.

The invention is an improved separable or opening structure or portion for use with a container or other item formed of printable sheet material and having at least one partially separable portion, or one or more items or portions that are connectable with, or separable from one another or combination thereof. A few examples of single or multiple use "items" include envelopes, re-usable envelopes, window envelopes, inline envelopes, welded envelopes, overnight carriers, reusable overnight carriers, boxes, reusable boxes, folded forms, re-usable forms, pressure seal forms, cartons, containers, postcards, printed forms and packaging constructed of uncoated or coated paper, cardboard, chipboard, C1S board, pulp composite, fibrous, or other synthetic material or window material or paper patch or label or any other suitable material or a combination thereof. The at least partially separable portion or portions may be embodied in one or more panels, sections, or may be detachably affixed to or separable from other layers, patches or any other part or parts of the item or container, or any desirable combination thereof. The invention is in no way limited by the type, construction, form, configuration, use or any other details or features of the item with which it is or may be used.

The opening or separable structure of the invention includes at least one partially separable portion formed by at least one tearable line that is formed by at least one "connector" and/or at least two "cut lines". To form a cut line, the item, or the panel, section, portions, parts or components thereof, may be weakened in any suitable desired manner, such as, for example, by having at least one score, cut, indentation, thin section or any combination thereof formed therein. The connector may be any desired, suitable mechanism for connecting the separable portion such as, for example, a gap or spacing approximate at least two cut lines forming a tearable line, or between at least one cut line and a fold line or other sheet material portion. The invention may also feature a staggered or angled or bent or overlapping or intersecting or converging pattern of cut lines and connectors that may be incorporated to strengthen the formed tearable line or lines, portion or portions such that the tearable line or lines forming the separable portion or portions can be customized to function reliably for its purpose, desired tearing path and manufacturing method based on the type of sheet material or thickness of paper or substrate and design that is utilized to manufacture the corresponding at least partially separable portion.

The overlapping or intersecting or converging pattern of cut lines and connectors may also be configured with channeling cuts that extend or partially extend to ensure that the tearing is controlled or redirected in a specific direction or desired path, or this provides a method which enables the cut lines to be further separated from each other or positioned in at least a partially overlapping pattern forming stronger connector areas that make the tearable line or lines, portion or portions stronger and more reliable for manufacturing, insertion, processing and function. A stronger tearable cut design may be positioned more closely or proximate to a fold line or lines or void or window area or areas, and or positioned on or across a fold line or lines, section or section, portion or portions while thereby ensuring reliable manufacturing, processing and function of the tearable portion or portions. The overlapping, intersecting or staggered or converging cut lines may be spaced apart from each other thereby forming connectors and in line with each other or proximate to each other so that when the separable portion is lifted in a desired direction along a tearable line, each cut line tears through the adjacent connector towards the next cut line, or channeling cut in a desired shape or path or direction.

When desired, one or more of layers and/or patches may be connected utilizing a point or points of affixation between or proximate to the at least partially separable portion or portions and the corresponding separable layered or affixed patch portion such as for example, windowed envelopes, windowed boxes, packaging, containers and forms where patch material(s) or layered structures may be affixed approximate to one or more separable portion(s). The layer or patch could also embody additional windows, layers or patches, printed graphics or other embellishments. The affixation mechanism may be any desired shape or size, which functions as a suitable mechanism for connecting or affixing the items, layers, patches or portions or any combination thereof such as, for example, glue, tape, adhesive, removable adhesive. repositionable adhesive, remoisten gums or glues, contact gums or glues, pressure seal adhesive, latex gums, peel-n-seal tapes, two-sided tapes, fugitive adhesives, magnetic material, hook and loop fastener, or any combination thereof.

When desired, a release cut or cuts may be incorporated into one or more affixed portions, items, containers, layers, patches approximate to one or more affixation points to control or limit the adhered fibrous tearing between at least one among two affixed portions, items, layers, patches, container portions when lifted and separated from the other. When desired, the separable portion or layer or patch may be utilized for additional graphic marketing, communication or messaging space such as a hidden offer, advertising, coupon, repositionable note, or instructional graphics etc. or other embellishments like scratch off areas, labels, sound chips, credit or membership cards, 3-D pop-ups. The one or more at least partially separable portions or layers or patches may also embody printed graphics, photos, ads or other embellishments like repositionable adhesive areas, release coating areas, permanent adhesive areas, removable or scratch off labels, scratch off areas, membership cards, parking stickers, embossing, carbon or carbonless coating areas, die cut areas or any other desirable enhancement or combination thereof. The at least partially separable portions or layers or patches may also incorporate an area or areas that embody a polymer release coating that allow the release of corresponding permanent or removable adhesive area or areas.

When desired the at least partially separable portion or layer or patch may include a tearable or detachable section or sections that can be utilized as an advertising or messaging device such as for example a coupon or reminder note or part of reply or interactive method, or simply to remove a desired portion or section of the separable portion, or layer or patch for desired purpose such as for example the removal of outbound graphics, addressing and mail processing markings such as postage or presort markings etc for a another purpose or reuse. When desired the separable portion or portions, layer or layers, patch or patches may also incorporate a method to reseal and or reuse the remaining container portion or portions, item or items. Any desirable sealing or affixing method could be used to reseal or reuse the remaining container portion or item or layer, such as for example, adhesive, remoisten gum, peel-n-seal tape, glue, contact adhesives, hook and loop fastener, magnetic material, static bonding material, interlocking slits or cuts, string, button, hook etc or any combination thereof.

The invention may have one or more of the following features, capabilities, functions or benefits: to allow for easy opening or separation or controlled tearing of one or more portions of one or more items; to allow for reliable connection of one or more separable portions of one or more items; to allow for easy separation of one or more portions of one or more items; to allow for easy opening of one or more portions of an item or an area; to allow for easy separation or controlled tearing or release of one or more portions of one or more items; controlling, limiting, minimizing or eliminating the damage to the separable portions, layers, patches that have been connected with the use of one or more weakened areas, connectors or intersecting or overlapping control tear lines and or affixing mechanisms and is separated or disconnected; reducing, limiting or controlling the tearing of the paper or substrate at or near one or more weakened area, cut line, connector or affixation mechanism on a separable portions, layer or patch; to preserve a separable portions, layer, patch or remaining portion or portions of an item or items for other use or reuse or continued use; to incorporate one or more methods to reseal or reclose the remaining container portion or portions of an item or items; to facilitate the detachment or separation of a portion or portions of the opening portion or portions from an item or items; to facilitate a method to display and when desired the removal of a portion or portions that may display graphics or information such as the outbound addressing information—for example, postage, stamps, indicia, postnet bar codes, IMB, cancellation marks or any other mailing or shipping information that would hinder the reuse, remailing or re shipping of the reusable portions, item or items; to incorporate a method to display necessary graphics, postage methods, account information and addressing information for use or reuse for mailing, shipping or interoffice use such as for example a die cut window, printed paper patch, label, or any type of form, label or insert that may be enclosed to display first or subsequent re-use information or any combination thereof; to prevent or reduce damage to graphics or other components or elements of a portion or portions of an item or items with which one or more connector mechanisms has been connected and or affixed and disconnected; to enable greater functionality and use of an item or portion of an item that has been connected and disconnected or separated with the use of one or more connecting and or affixing mechanisms; to preserve the appearance and/or integrity of an item or portion of an item that has been connected and disconnected with the use of one or more affixation mechanisms; to remove or reduce uncertainty in determining the quantity and extent of each connector to include on an item having at least one affixation mechanism during manufacturing; to simplify the manufacturing process of items; to remove or reduce the potential for problems in the processing and handling of items having opening or removable sections or portions; to allow easy use of manufacturing and handling equipment, such as inserting and sealing equipment, sorting and presorting processing methods and package processing equipment; to provide an intuitive mechanism for opening or separating an item or portion of an item that has been connected and disconnected with the use of one or more affixation mechanism; to provide tab shape, exposed edge, pop up edge, un-affixed or un-connected edge for the gripping and easy opening of an item or portion of an item; to make it easier to understand how to open or separate or both, and to open or separate an item or portion of an item; to enable, allow the use of, or preserve ornamental portions or designs, such as, for example, that simulate outlines of an object or objects, shape or shapes such as, animals, horizons, round, oval, square, rectangular, curved to conform to a graphic shape or the like on items having one or more connector or affixation mechanisms; to allow easy and intuitive access into an item or items; to provide dependable, easy-open functioning, separation release thereby limiting or controlling the fiber tear between connected portions and or items; to enable the manufacture, sealing and use of items with minimal connectors or affixation mechanisms or combinations thereof; to prevent the accidental opening of a perforation line or lines on an item; to use existing manufacturing technologies for providing any of the above; to utilize the space or areas within the at least partially separable or connected portions, layers, patches or items for other purposes such as additional marketing, messaging, branding, communications such as coupons, notes, offers, advertising, solicitations of one or more parties' services or products, or to incorporate other interactive or ornamental features such as scratch off areas or labels, pop-up mechanisms, affixed cards, tags, membership cards, winning tickets, additional windows, layers or any desirable embellishment or combination thereof; and to incorporate a systematic and actionable separation or opening process that is intuitive and methodical thereby creating a strategy or process for the creative team, package designer, marketer, direct mail strategist, copywriter etc. to integrate or present communications, messaging, actionable or interactive features, enclosures or embellishments to the recipient.

The invention utilizes an odd number of cuts to form at least two open "V" shaped tearing pathways, lines or sections. A three cut design has two opposing tearing pathways whereby one cut is shared in the middle and is common to form the opposing set of tearable lines. A five cut pattern forms two sets of tearable lines (four tearable lines—two lines tear in one direction and two other lines tear in the opposing direction) that form opposing tearable sections or strips. Two sets of the three cut pattern can be spaced apart and parallel so as to make two opposing tearable sections or strips with an adjustable width. Space the two cut patterns closer and the tearable section is smaller, and as the two three cut patterns are spaced apart the tearable section or strip becomes wider. These patterns can be spaced in a linear or parallel pattern or be positioned along a curved tearing pathway or design that follows a desired shape or path. Starting mechanisms for the patterns start at the edge of a sheet or a form and also within the panel of a form or sheet including along the edge of a window.

DESCRIPTION OF THE DRAWINGS

The above as well as other advantages of the invention will become readily apparent to those skilled in the art from the following detailed description of a preferred embodiment when considered in the light of the accompanying drawings in which:

FIGS. 3A-3C show a second embodiment envelope.

DESCRIPTION OF THE PREFERRED EMBODIMENT

Figures 1A, 1B, 1C, 1D, 2A, 2B, 2C, 2D:
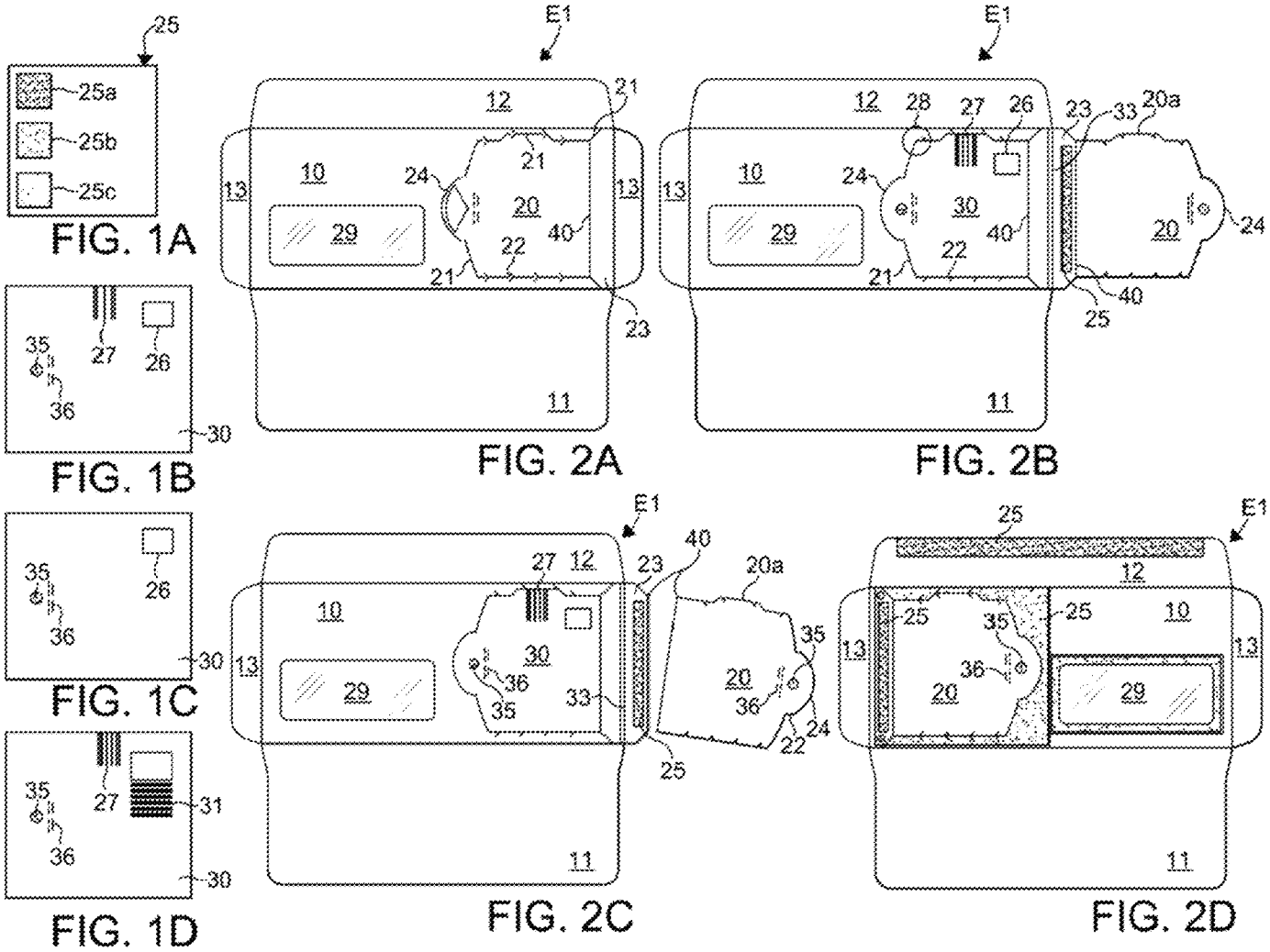
FIGS. 1A-1D show a second layer or patch for use with a sheet material item according to the invention.
FIGS. 2A-2D show a sheet material item in the form of an envelope with a separable portion and the second layer or patch.

The U.S. provisional patent application Ser. No. 61/778,603 filed Mar. 13, 2013 is incorporated herein by reference.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

In the attached drawings of various examples of the invention, a first layer or an at least partially or fully separable portion is referenced by the numeral 20 and has edges formed by a series of intersecting cuts or weakened areas referred to as cut lines 21 spaced apart by solid areas referred to as connectors 22. The cut lines 21 and connectors 22 are positioned to form a tearable line as the separable portion 20 is lifted thereby tearing the corresponding connectors 22 in a desired direction or path forming the shape of the at least partially separable portion 20. Redirecting or at least partially overlapping channeling cuts 28 may be incorporated proximate the series of cut lines 21 so as to ensure the tearing action is controlled and directed in the desired direction and path that forms the separable portion or opening section 20. When desired the channeling cuts 28 may also cooperate with the connectors 22 to add strength and to ensure reliable manufacture, processing and use. Any quantity, size, shape and orientation of cut lines 21, channeling cuts 28 and corresponding connectors 22 or any combination thereof may be used to form the tearable line that forms the at least partially separable portion 20 or portions which are embodied in the invention.

A second layer or patch is referenced by the numeral 30, and may be applied when desired proximate to the at least partially separable portion and or to the adjacent portion or portions. The patch material may be made of any desirable substrate such as paper, clear window material, foil, cellophane, polyester, synthetic substrate etc and may be printed or embellished for any desirable purpose.

Also shown in the drawings are various attachment devices 25 such as a remoisten glue area 25*a*, a gum area 25*b* and a peel-n-seal strip 25*c* on the patch 30 as shown in FIG. 1A. There is shown in FIGS. 1B and 1C instructional graphics 26 for applying postage. There is shown in FIGS. 1B and 1D a FIM bar code 27 affixed to the patch 30. The patch 30 can have an affixation point 35 and/or a release cut 36 as shown in FIGS. 1B, 1C and 1D. As shown in FIG. 1D, the patch 30 can have a return postage graphic 31 affixed thereto.

The separable portion 20 and the second layer or patch 30 may have any respective shape, size, orientation, configuration, form and location, as is desired. A few examples of different shaped separable or opening portions 20 are shown in accompanying drawings. The series of cut lines 21 and connectors 22 that form a separable portion 20 may be any desired length or shape to form the separable or opening portion 20. When desired the at least partially separable portion 20 and the second layer or patch 30 may be connected by an affixation point or points 35 that connect the separable portion to the layer or patch for such purposes as reliable manufacturing, processing and use methods etc. When desired release cuts 36 may be incorporated proximate to a point or points of affixation 35 on the separable portion 20 and/or corresponding layer or patch 30 so as to allow the controlled release or easy separation of the affixed separable portion 20 and layer or patch 30 by limiting or ending the tearing of the adhered surface fibers on the affixed separable portion 20 and/or corresponding layer or patch 30. Any desired shape, size and configuration or combination of release cut(s) 36 or desired affixation mechanism(s) 35 may be utilized to connect and thereby enable the controlled release or separation of the separable portion 20 and the corresponding layer or patch 30. When desired the affixation mechanism or mechanisms may utilize a repositionable or releasable adhesive method or process that does not require the release cuts, so as to enable reclosure or reuse of the container or the separable or opening portion or section or sections thereof. Or when desired to incorporate a method to reuse or reapply a detachable section or portion of the separable opening portion or sections thereof to another item such as for example a note in a Day-Timer® planner, a coupon or offer etc.

In some embodiments, the weakened areas or release cuts 36 are located proximate to an affixation mechanism 35. In such embodiments, the weakened area and affixation mechanism may be configured and positioned in any desired manner. FIG. 2C shows one example of release cuts or weakened areas 36 located proximate to the trailing or tearing side of the affixation mechanisms 35. In other examples, not shown, the weakened area or release cuts may entirely surround the affixation mechanism on one or both of the separable affixed portion 20 and the layer or patch 30. In other examples not shown, the weakened area only partially surrounds the affixation mechanism. In yet other examples, the weakened area is merely adjacent to part of the affixation mechanism. However, the illustrated examples are in no way limiting upon the invention and there are an infinite number of other possible combinations of different shaped, sized, oriented and positioned pairs of weakened areas/affixation mechanisms. Thus, when one or more weakened area or release cut is used along with one or more affixation mechanism, any positioning thereof may be used. For a few other examples (not shown), the weakened area(s) or release cuts may be positioned just outside, within, adjacent to or toward the trailing side of the affixation mechanism(s).

FIGS. 2A-2D illustrate a reusable embodiment of the current invention whereby an opening or separable portion 20 is incorporated in and integral with a face panel 10 of a printable sheet material in the form of an inside side seam envelope E1 having a side flap 13 at each end or side edge and which also features an address window 29 formed therein. A back panel 11 is attached to a bottom edge of the face panel 10 and an initial seal flap 12 is attached to a top edge. FIG. 2A shows the outside of the envelope E1 with the separable portion 20 attached to the face panel 10. FIG. 2B shows the separable portion 20 detached from the face panel 10 along three edges and moved to expose the second layer or patch 30. FIG. 2C shows the separable portion 20 completely detached from the face panel 10. FIG. 2D shows the inside of the envelope E1.

There is a tab shaped opening or starting mechanism 24 integrated in the outline of the intersecting cuts 21 and connectors 22 that form the tearable line or lines that form three edges of the separable or opening portion 20. The tab 24 is an option but forms a functional and intuitive device that can be utilized to help the recipient initiate the lifting and subsequent tearing of the intersecting tearable cuts 21 and connectors 22. There is a second perforated tearable line 40 incorporated in the separable or opening portion 20 whereby a section or portion of the separable or opening portion 20 can be separated and detached from the front panel 10 subsequently leaving a second seal flap portion 23 attached to the remaining portion of the container or envelope E1 which serves as a method to reuse and reseal the remaining container portion for mailing purposes. The second seal flap portion 23 includes an attachment device 25 such as a remoisten glue area.

A second layer or patch 30 is applied proximate to the separable opening portion 20 and features one affixation point 35 and release cuts 36 proximate to the opening tab shape 24 to ensure reliable manufacturing, insertion, mail processing, opening function, reusable function. The separable portion 20 also displays instructional graphics 26 to apply a stamp or postage for remailing and also may display a FIM bar code 27 used for automation mail processing methods. There is a hump 20*a* in the top edge of the separable portion 20 so as to display more of the postal FIM bar graphics 27. If desired, the path of the tearable lines forming edges of the separable portion 20 could be straightened and if desired the side flap 13 where the tearable lines extend could be shortened to the same height (not shown) to allow the end of the separable portion to open fully along the side whereby the separable portion is connected. There are two patch configurations shown (FIGS. 1A-1C and FIGS. 2A-2D) and many others not shown. The at least partially separable structure 20 opens from left to right but could be adjusted to open in any direction, towards any edge of the front panel 10 or any combination thereof. If desired the separable portion 20 could extend to an adjacent or connected back or side panel.

Another embodiment of the invention includes a printable sheet material in the form of an envelope E2 as shown in FIGS. 3A-3C. This embodiment is a reusable closed face inside side seam envelope which utilizes a single large separable or opening portion 20 and no second address window. FIG. 3A is an outside view and FIGS. 3B and 3C are inside views. This configuration features a void or section 32 that has been removed from the front panel 10 so as to form a tab shape which allows easier access to the edge of the portion 20 for easy grasping, lifting and opening. The series of cut lines 21 that form the tearable line that forms the edges of the separable portion 20 do not overlap but are positioned closely to minimize the connectors 22 that are formed by the spacing between the cuts so as to ensure tearing in the desired shape and path required to form the separable portion 20. The outbound address, postage or shipping information (not shown) is imaged or written directly on the at least partially separable portion 20 such that when desired can be detached so that the remaining Portion of the container E2 can be reused, resealed or remailed. There are three patch 30 configurations shown (Business Reply Mail 30*a*, courtesy reply regular stamp 30*b*, and courtesy reply meter 30*c*), but many others are not shown including a clear patch material. The at least partially separable structure 20 opens from left to right, but could be adjusted to open in any direction, towards any edge or any combination thereof.

Figure 4A:
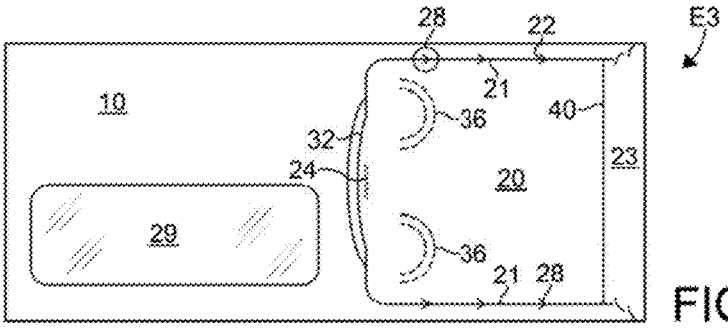
FIGS. 4A-4D show a third embodiment envelope.
Figure 4B:
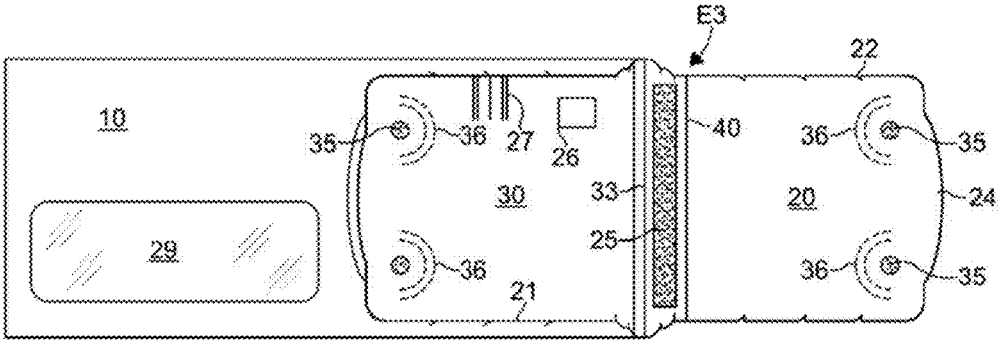
Figure 4C:
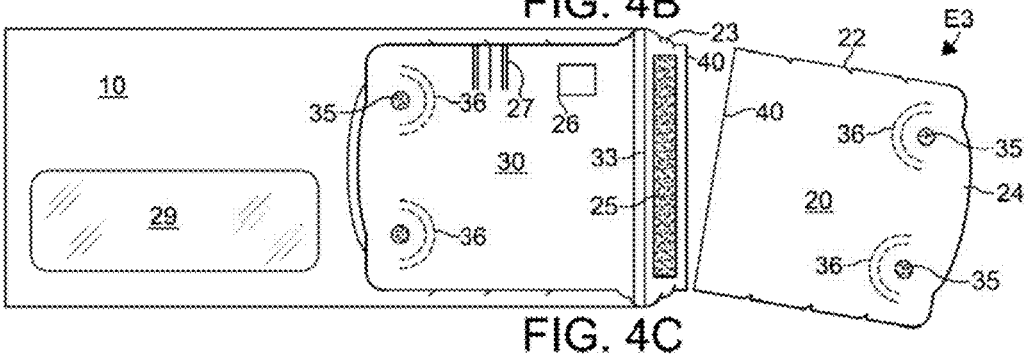
Figure 4D:
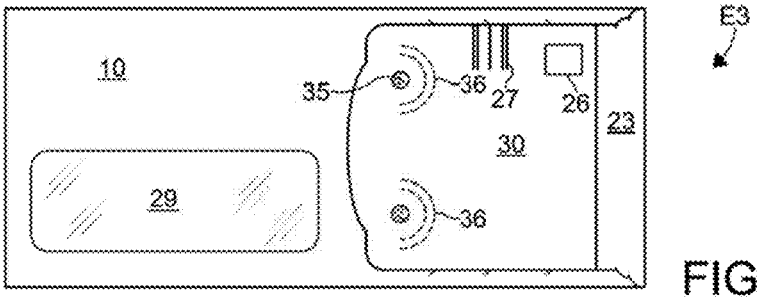

A third embodiment of the invention is an envelope E3 shown in FIGS. 4A-4D that illustrate the four steps to open, reuse or reseal the envelope. The printable sheet material envelope E3 has a short opening portion 20 which incorporates a void area 32 whereby the recipient can grasp the opening tab shape 24, lift and pull the opening portion to the right thereby tearing the intersecting cuts 21 and connectors 22 in a specific path forming the edges of the at least partially separable or opening section 20. The intersecting cuts 21 and connectors 22 travel mostly straight across the face and at the perforation line 40 extend to the top and bottom corners of the right side of the envelope E3 thereby forming the second seal flap 23 in this configuration. There is also an address window 29 in the body of the envelope E3 which is used to display variable address and mailing information. In FIG. 4C the opening portion 20 can be subsequently detached along the perforation line 40 to free the second seal flap 23 which is formed with a remoisten gum area 25 for sealing and remailing or a second use. The patch 30 features a FIM bar code 27 and affix stamp instructions 26 for return mailing. It could also feature other FIM or return mailing or shipping information. The opening portion 20 and patch 30 also feature two affixation areas 35 which also include an arcuate pair of release cuts 36 that encompass at least half of the circumference of the affixed area.

There are various shapes and configurations of envelope structures that can incorporate the invention—side seam, booklet, catalog, diagonal seam etc. There are many other container applications that can incorporate the invention— for example, folded forms, pressure seal forms, boxes, packaging, overnight carriers, reusable overnight carriers, etc.

Figure 5C:
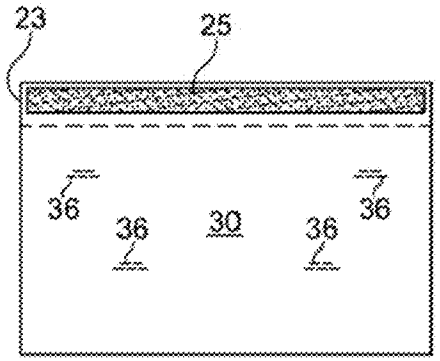
FIGS. 5A-5D show a fourth embodiment envelope.
Figure 5D:
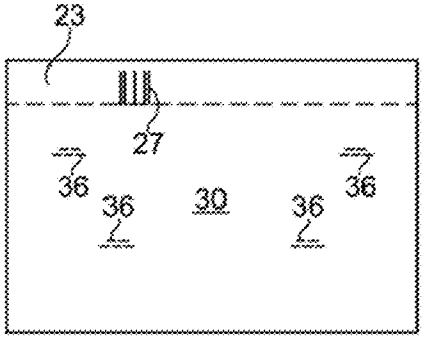
Figure 5B:
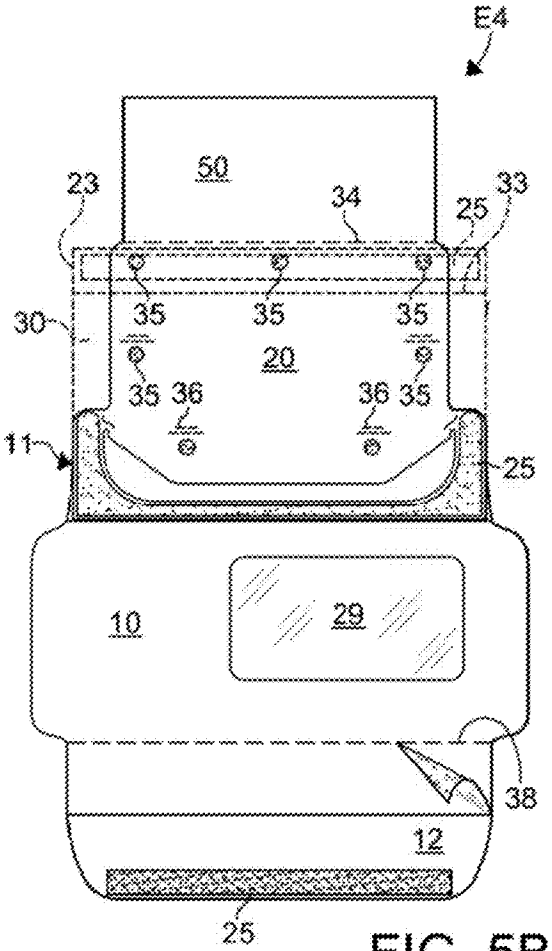
Figure 5A:
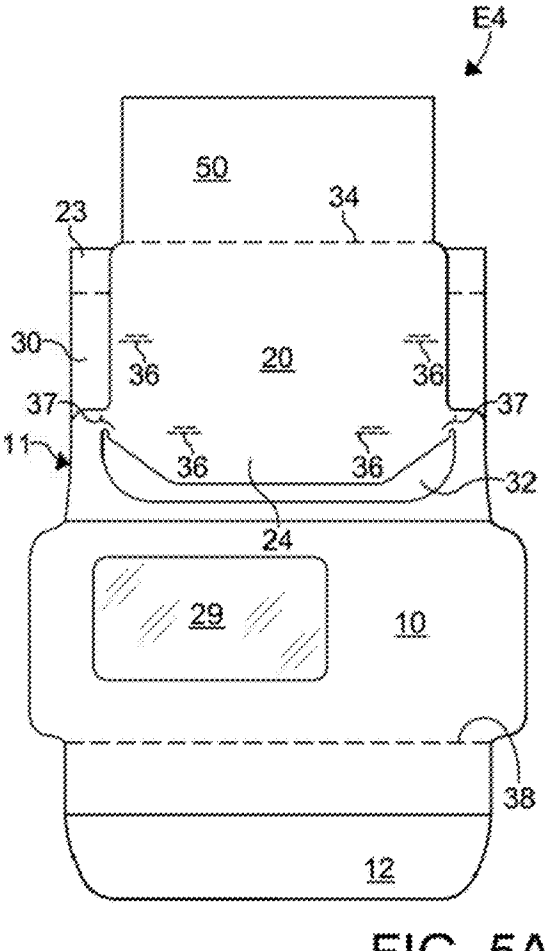

FIG. 5A is an outside view and FIG. 5B is an inside view of a fourth embodiment of the invention including a printable sheet material in the form of an envelope E4 where the separable or opening portion 20 is incorporated into the back panel 11 of a side seam envelope. There is a void section 32 that forms a tab opening mechanism 24 and a second layer or patch 30 is attached proximate to the inside of the back panel short of a fold line 33 where an inside bangtail flap 50 extends. Additional points of affixation 35 and corresponding release cuts 36 may be incorporated between the second layer or patch 30 and the separable or opening portion 20. If desired some of the affixation points or spots may not incorporate release cuts (see the three spots 35 closest to bangtail fold line 34). The bangtail section 50 may also have a tearable perforation line 34 located between the back panel 11 and the section that extends to form the bangtail section 50. The outbound address window 29 is shown on the front panel 10 of this envelope, but could be located on the back panel 11 as an option.

When the recipient receives this envelope he/she simply turns to the back side, lifts and pulls the opening tab shape 24 towards the outbound seal flap 23 thereby tearing or breaking a tearable line 37 that intersects the outer edge of the back panel 11 which allows the separable opening portion 20 to detach from the points of affixation 35 on the patch or second layer 30. Once the opening section 20 is separated from the patch 30, the separable portion 20 remains attached to the outbound seal flap 23. To reuse or remail this envelope E4, one would simple tear off the separable portion 20 which is affixed to the original seal flap portion 12 and a portion of the front panel 10 of the envelope along a horizontal perforation or tearable line 38 which is short of the second seal portion or flap 23 at the edge of the patch 30. As shown in FIG. 5C, the second seal flap 23 can include the attachment device 25 on one side and, as shown in FIG. 5D, the FIM bar code 27 on the other side. The second seal flap could be incorporated proximate to the initial seal flap fold line on a foldable face panel portion that would embody a resealing method or adhesive. The remaining back panel section or patch portion that forms the back throat on the remaining opened container portion would be slightly shorter than illustrated when the second seal flap is configured on a foldable portion on the face panel, proximate to the initial seal flap section or panel.

There is another bangtail configuration (not shown) whereby the extended bangtail section folds to the outside of the back panel and is affixedly attached to the back panel with an affixing point or points that may or may not require corresponding release cuts. A patch or second layer is not required. The end of the bangtail section becomes the opening mechanism for the envelope as the initial seal flap is sealed to the lower section proximate to the fold line of the extended bangtail section. Additional perforations may be incorporated in the bangtail to divide into sections that can subsequently be separated or detached.

Figure 6A:
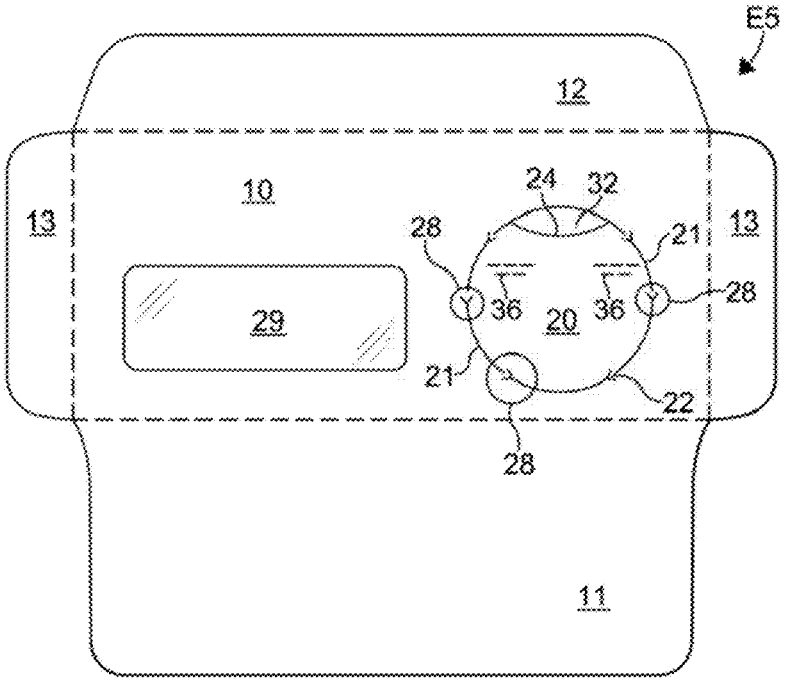
FIGS. 6A-6C show a fifth embodiment envelope.
Figure 6B:
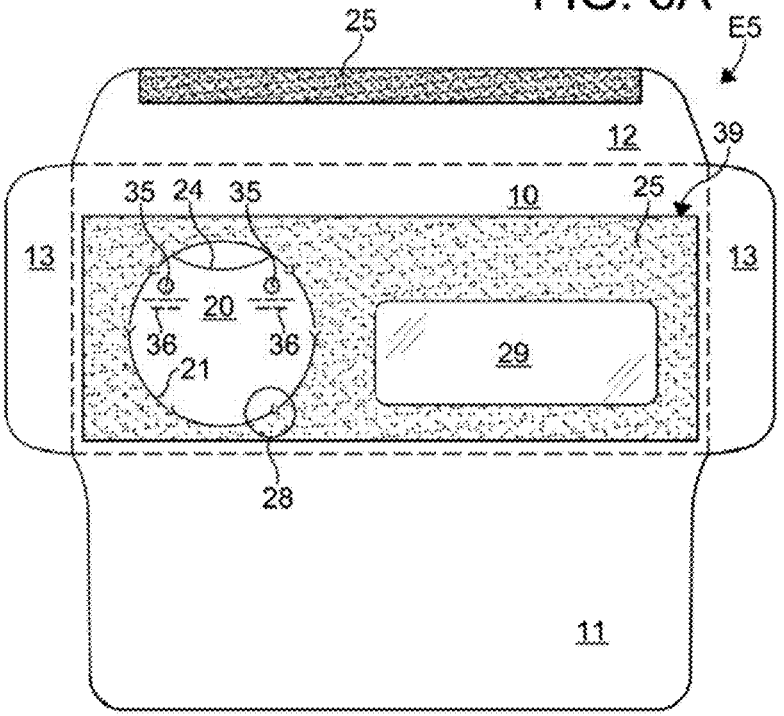

FIG. 6A is an outside view and FIG. 6B is an inside view of a fifth embodiment of the invention including a printable sheet material in the form of an envelope E5 illustrating an at least a partially separable portion or portions 20 that are designed to be lifted and separated from adjacent portions of the envelope in a shape or figure or opening that may expose a message or graphics that may appear through the opening, on a patch or affixed layer 30 proximate to the opening or through a clear window material to an insert that is enclosed inside. The separable portion 20 could be useful for many other purposes. As shown in FIG. 6A, separable portion 20 has a mostly circular shape with a void area 32 at the top to form an open area to access a lifting edge or tab 24. Thus, the separable portion 20 incorporates an intuitive opening process or method that ensures the intersecting tearable cuts 21 and connectors 22 function properly. The overlapping V-shaped channeling cuts 28 may be incorporated to ensure that as each connector 22 tears it is channeled or redirected to tear in a desired direction which follows the path or shape of the separable or partially separable portion 20.

Figure 6C:
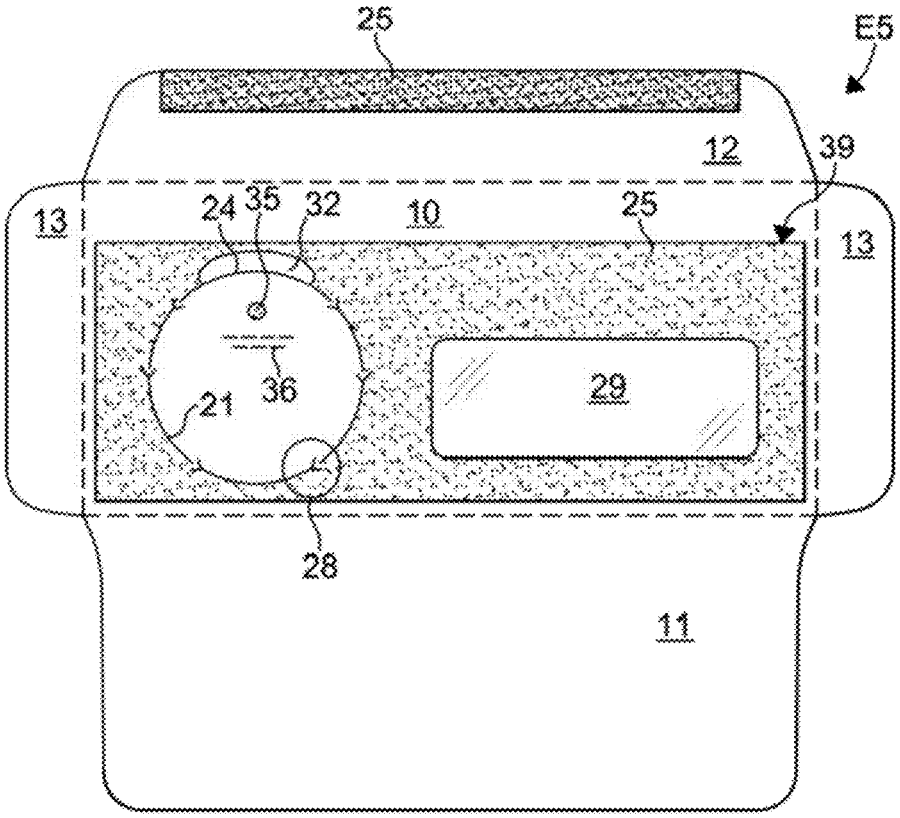

FIG. 6B shows a shaded area that is patch gum, the points of affixation 35 and the corresponding release cuts 36 that may be utilized as desired. The clear window patch 30 extends proximate to both the separable portion 20 and the address window area 29. FIG. 6C is an inside view of the envelope E5 with the circular separable portion 20 and the void area 32 extending above the edge of circular separable portion. It also features the optional points of affixation 35 and the corresponding release cuts 36.

Figure 7A:
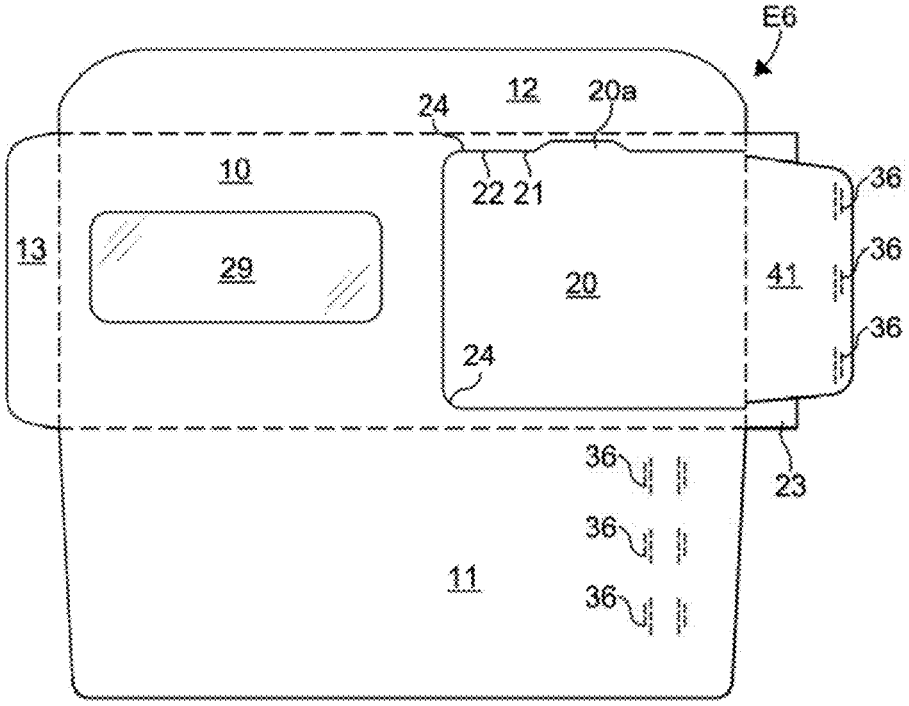
FIGS. 7A-7B show a sixth embodiment envelope.
Figure 7B:
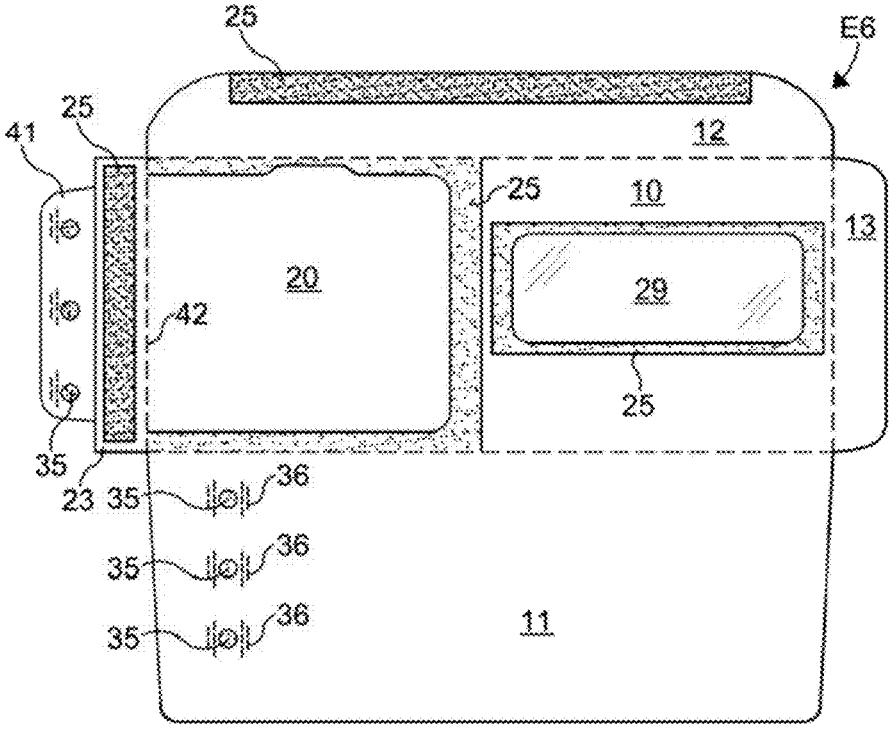

FIG. 7A is an outside view and FIG. 7B is an inside view of a sixth embodiment of the invention including a printable sheet material in the form of an envelope E6 that is a combination inside side seam or flap on one side and an outside side seam or flap on the other side. The reusable envelope design E6 utilizes an opening mechanism as part of the at least partially separable portion 20 on the front panel 10 that extends around the right edge fold line and extends on the envelope portion that is the outside side seam portion 41. Patch material 30 may be attached proximate to the separable or opening portion 20 and in this embodiment extends beyond the fold line 42 short of the end of the portion forming the outside side seam flap 41. The patch 30 also embodies a resealing attachment device 25 and a foldable second seal flap 23 whereby when the opening portion 20 is lifted and separated beyond the fold line 42 and beyond the extended patch portion, the portion 20 separates or detaches from the corresponding points of affixation 35 on the back panel 11 of the envelope exposing the extended second seal flap portion 23 of the patch 30 that allows access to the enclosed contents. Subsequently the second seal flap 23 may be incorporated to reseal the remaining container portions for reuse or remailing or other purposes. The at least partially separable portion 20 extends to and is contiguous to the portion that is utilized as the outside side seam flap 41 and wraps around to the corresponding back panel section 11 that may also include release cuts 36 proximate to the affixation points 35 on one or both portions to control and facilitate the release or detachment of the two affixed portions thereof. The separable portion 20 could be configured to tear off at the fold line 42 or any functional point if desired (not shown). This embodiment could also be an outside or inside side seam configuration or a glued side seam (not shown).

Figure 8A:
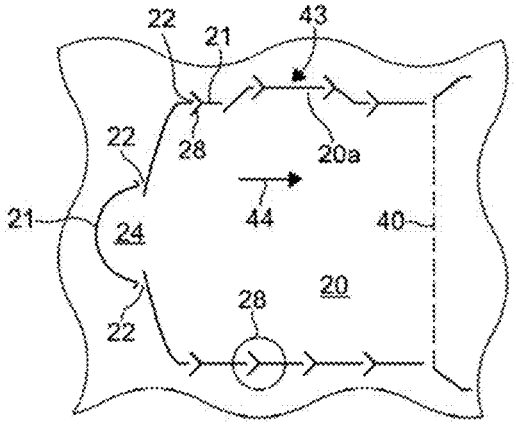
FIGS. 8A-8F are illustrations of various tear line configurations used in the invention.
Figure 8B:
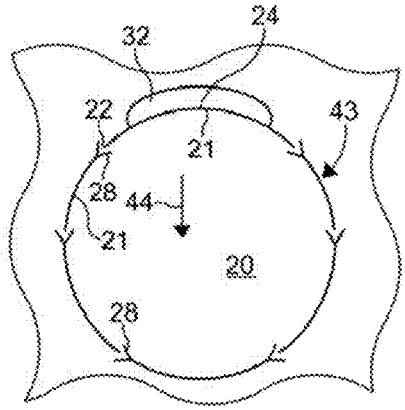

FIGS. 8A-8E are views of some of the possible tearable line configurations utilized in the invention. FIG. 8A shows most of an opening or separable portion 20 with a plurality of the cut lines 21 and connectors 22 forming a tearable line 43. The tearable line 43 also includes a tab 24 and overlapping, channeling cuts 28 connected to ends of some of the cut lines 21 which allow easier separation of the cut lines 21 and which make the connectors 22 stronger for reliable manufacturing, processing and use purposes. FIG. 8A is a good example of one feature of the invention whereby a large, random shaped area can be assembled and ultimately separated into a desired shape or area. An arrow 44 indicates a direction of tearing along the tearable line 43 as the tab 24 is pulled from left to right. FIG. 8B shows the cut lines 21, the connectors 22 and the channeling cuts 28 in a basically circular formation of the tearable line 43 forming the edge of the separable portion 20. Access to the edge of the top of the circle may be made easier by incorporating a void area 32 which forms an intuitive tab 24.

Figure 8C:
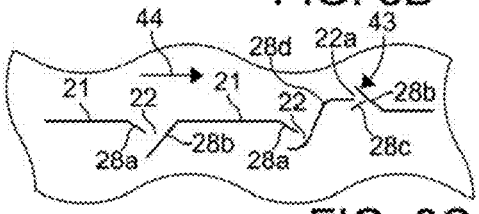
Figure 8D:
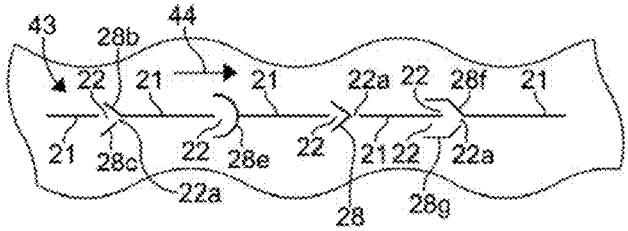

FIGS. 8C and 8D feature an enlarged view of several possible overlapping and channeling cut shapes to show the flexibility of some of the possible embodiments of the invention. In FIG. 8C, the channeling cut 28 at the left is separated into a first straight portion 28*a* connected to an end of one of the cut lines 21 and a second straight portion 28*b* connected to an adjacent end of another one of the cut lines 21. The channeling cut 28 at the right can further include a spaced third straight portion 28*c* adjacent the second portion 28*b* and/or a spaced S-shaped fourth portion 28*d* between the portions 28*a* and 28*b*. The channeling cut 28 may also incorporate areas of separation 22*a* between portions of the channeling cut which function like the connectors 22 within their shape or proximate to other tearable connectors 22 or cut lines 21. FIG. 8D shows from left to right: a channeling cut formed from the second portion 28*b*, the third portion 28*c* and the separation area 22*a*; a channeling cut formed from an arcuate fifth portion 28*e* connected to an end of one of the cut lines 21; a channeling cut formed from the V-shaped cut 28 spaced by the separation area 22*a*; and a channeling cut formed from a sixth bent portion 28*f* connected to an end of one of the cut lines 21 and a seventh bent portion 28*g* spaced from the cut line 21 by the separation area 22*a*. The shape and configuration is not limited to what is shown.

Figure 8E:
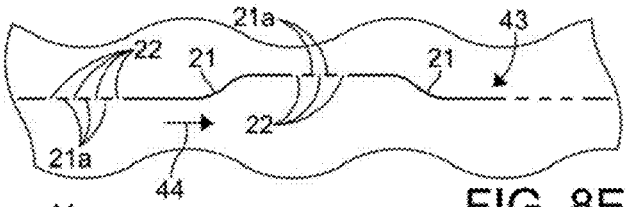

FIG. 8E shows a tearable line 43 configuration without any of the channeling cuts. Longer cut lines 21 have facing ends separated by sections having one or more shorter cut lines 21*a* alternating with the connectors 22 such that as the separable portion that is formed tears in the desired path or shape, it functions properly yet is strong enough for manufacturing, processing and use.

Figure 8F:
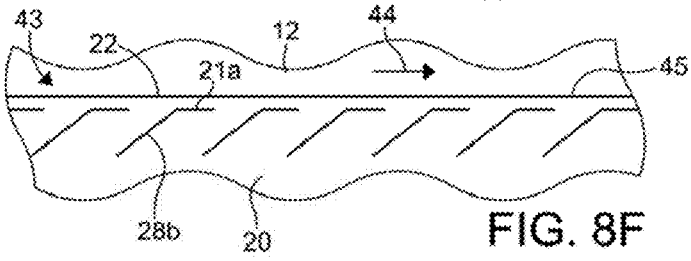

FIG. 8F shows a tearable line 43 configuration adjacent a folds line 45 separating the first seal flap 12 from the separable portion 20. The tearable line 43 includes a plurality of the shorter cut lines 21*a* alternating with the connectors 22. Each cut line 21*a* is connected at one end to an associated channeling cut 28*b* which allows easier separation of the cut lines 21*a* and which make the connectors 22 stronger for reliable manufacturing, processing and use purposes. As shown, the channeling cuts 28*b* extend away from the fold line 45.

Figure 9B:
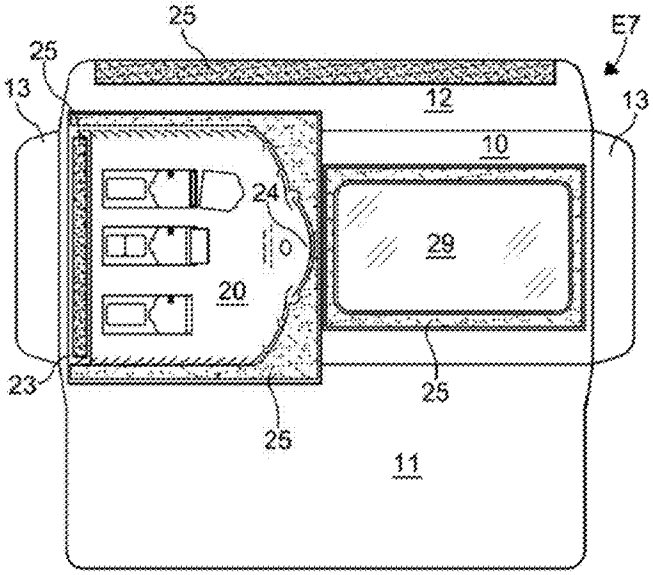
FIGS. 9A-9B show a seventh embodiment envelope.
Figure 9A:
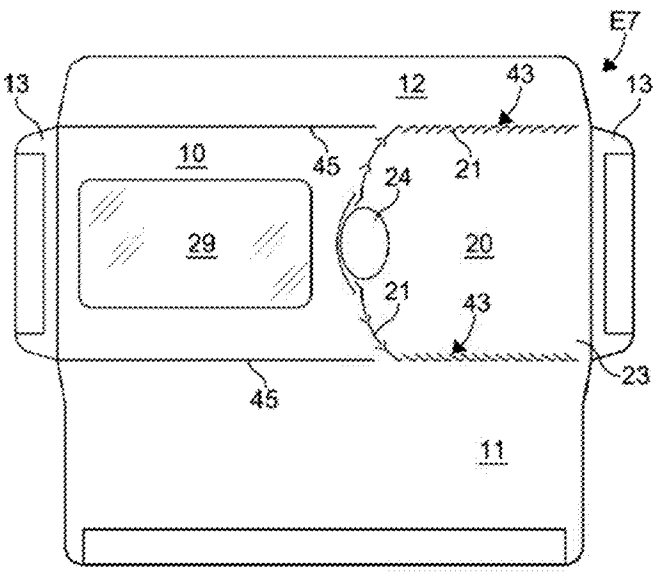
Figure 9A:
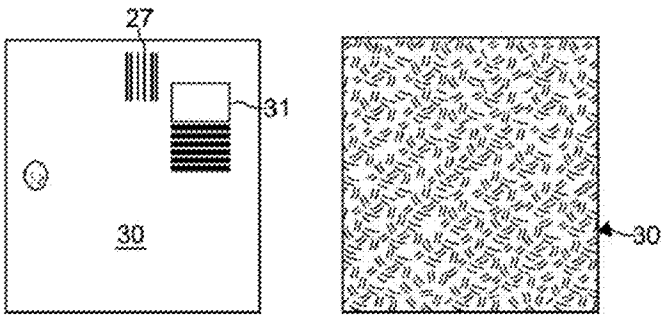

FIG. 9A is an outside view and FIG. 9B is an inside view of a seventh embodiment of the invention including a printable sheet material in the form of an envelope E7 that is similar to the envelope E1. The upper and lower edges of the separable portion 20 are adjacent the upper and lower fold lines 45 connecting the front panel 10 to the first seal flap 12 and the back panel 11 respectively. The upper and lower edges of the separable portion 20 are formed by a pair of the tearable lines 43 having the configuration shown in FIG. 8F. As shown in FIG. 9A, the envelope E7 is reusable with the patch 30 that can have the FIM bar code 27 and the return postage graphic 31 on a front side and a blank rear side or can be a one way envelope with a clear patch.

Figure 10:
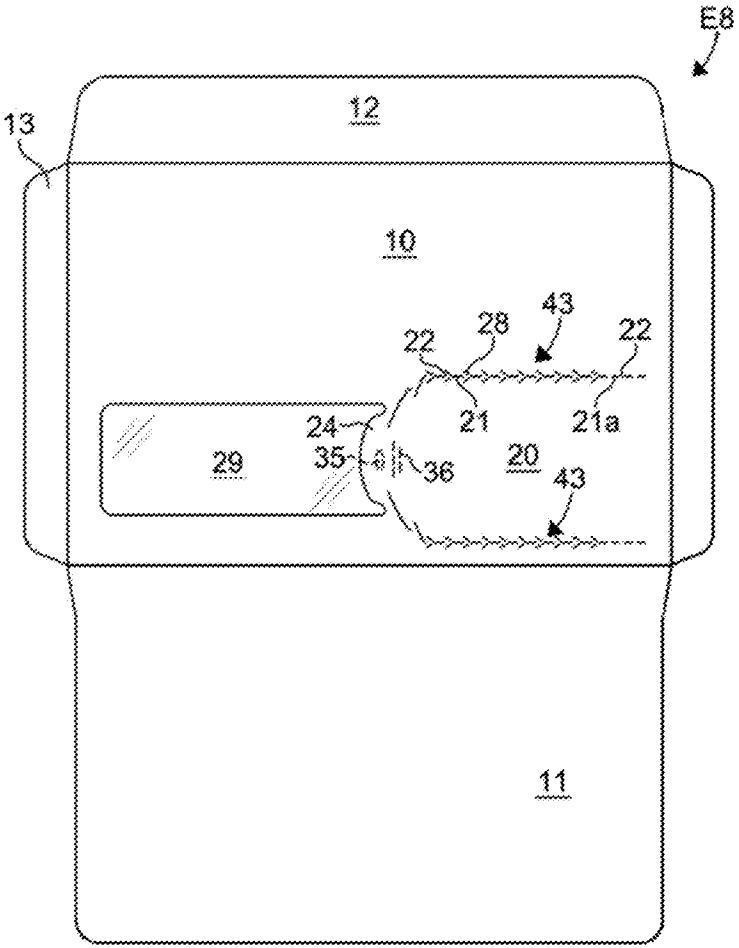
FIG. 10 shows an eighth embodiment envelope.

FIG. 10 is an outside view of an eighth embodiment of the invention including a printable sheet material in the form of an envelope E8 that is similar to the envelope E1. In this configuration, the converging tearable lines 43 are formed for a substantial distance by the longer cut lines 21, the connectors 22 and the channeling cuts 28. As the tearable lines 43 approach the right side flap 13, the configuration switches to the shorter cut lines 21*a* alternating with the connectors 22 without the channeling cuts 28 to improve control of the tearing path.

Figure 11:
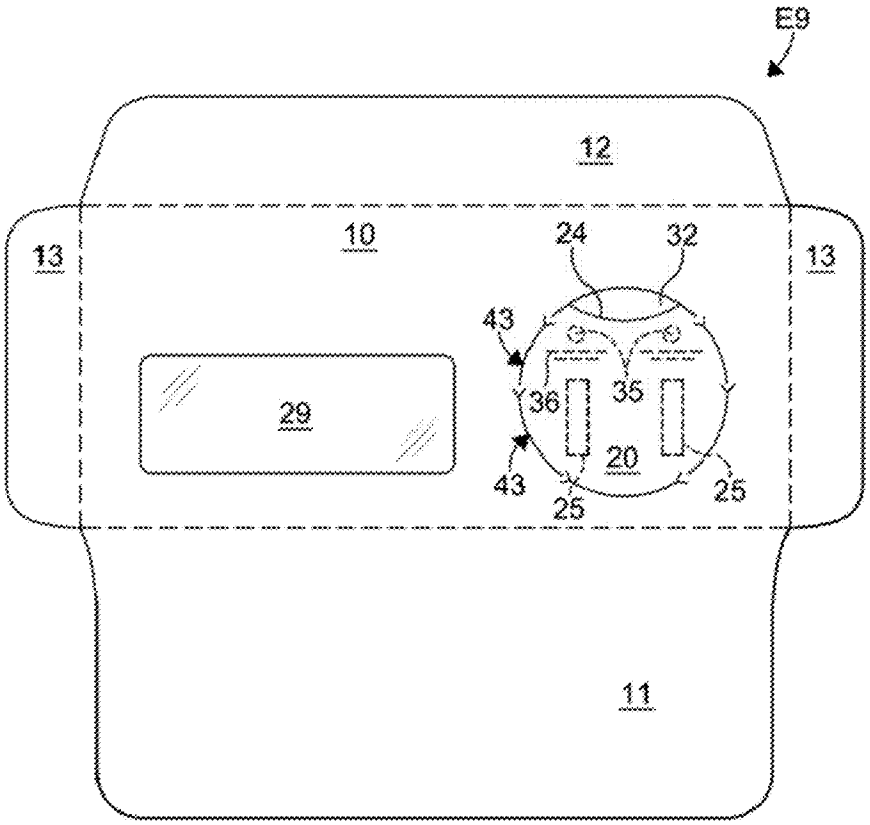
FIG. 11 shows a ninth embodiment envelope.

FIG. 11 is an outside view of a ninth embodiment of the invention including a printable sheet material in the form of an envelope E9 that is similar to the envelope E5. In this configuration, the separable portion 20 has a pair of attachment devices 25 affixed on the inside surface that can be used to adhesively attach the portion 20 to other objects when detached from the front panel 10.

Figure 12:
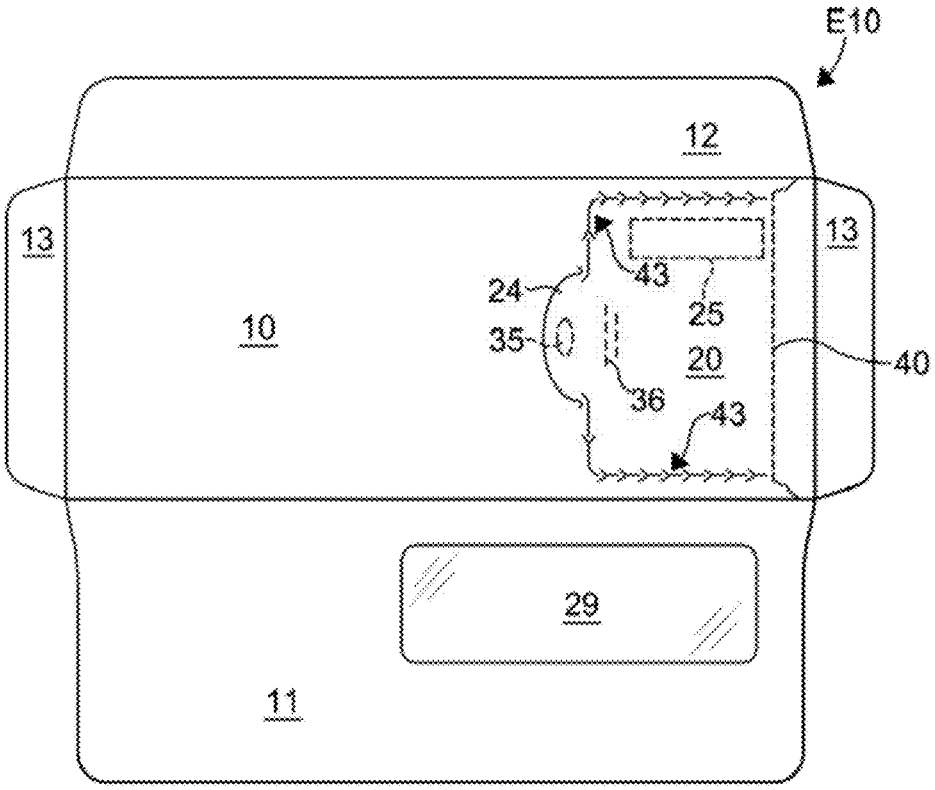
FIG. 12 shows a tenth embodiment envelope.

FIG. 12 is an outside view of a tenth embodiment of the invention including a printable sheet material in the form of an envelope E10 that is similar to the envelope E1. The tearable lines 43 incorporate a combination of overlapping and converging cuts to form the separable portion 20 that also can be detached at the perforation line 40. The separable portion 20 has an attachment device 25 affixed on the inside surface that can be used to adhesively attach the portion 20 to other objects when detached from the front panel 10, or re-affixed back to itself if not detached at the perforation line 40.

Figure 13:
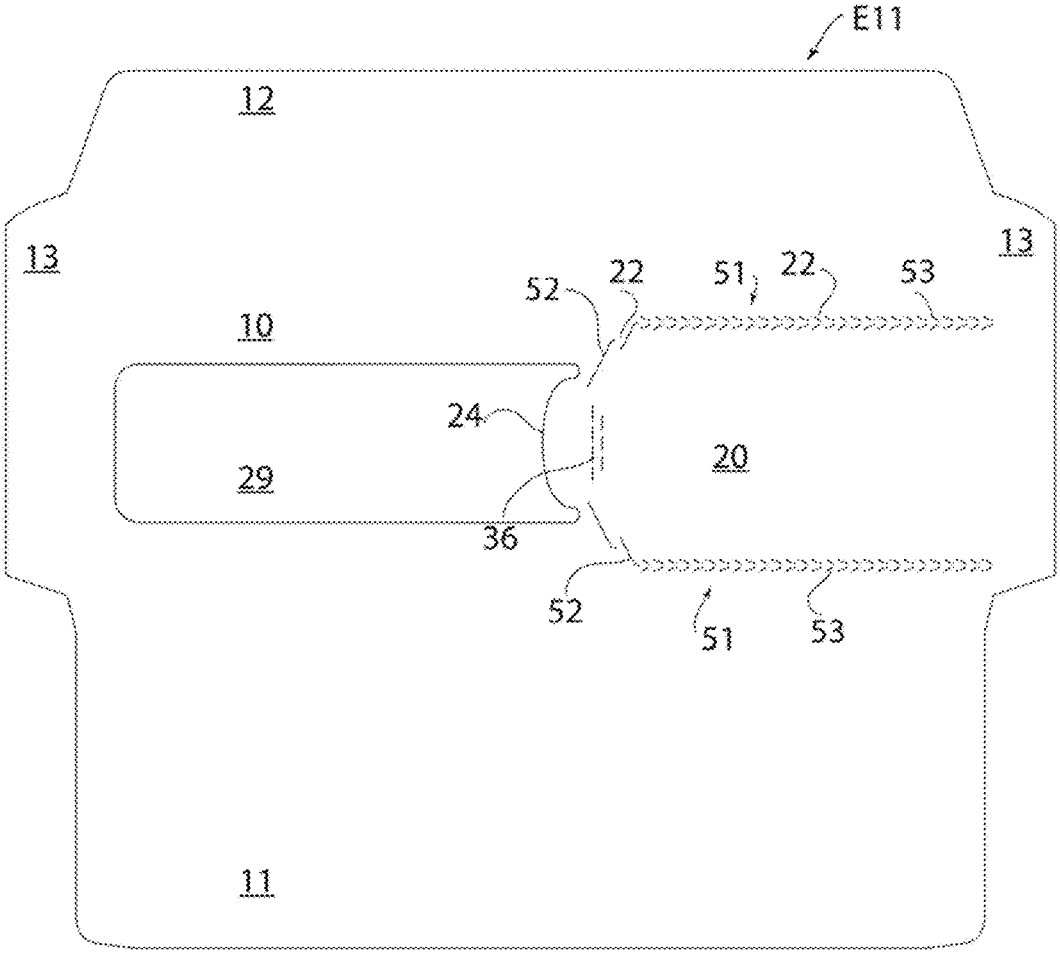
FIG. 13 shows an eleventh embodiment envelope.

FIG. 13 is an outside view of an eleventh embodiment of the invention including a printable sheet material in the form of an envelope E11 that is similar to the envelope E10. However, the address window 29 is formed in the face panel 10 and the tab 24 is located at an edge of the window. A pair of tearable lines 51 incorporates a combination of cut lines 52 and channeling cuts 53 to form the separable portion 20 with a generally rectangular shape that extends to the right side flap 13. The cut lines 52 are formed as overlapping "hockey stick" shapes that extend at angles relative to horizontal from the tab 24 toward the back panel 11 and the seal flap 12 respectively. Each channeling cut 53 is formed as an open "V" shape by a pair of converging cuts spaced wider apart at one end than at an opposite end. The channeling cuts 53 are spaced apart along the tearable line from the ends of the cut lines 52 extending in a straight line in the horizontal direction to the right side seal flap 13. The channeling cuts 53 are separated only by the connectors 22 and are oriented with the wider spaced end facing toward the tab 24 and the narrower spaced end facing toward the right side flap 13. Thus, the channeling cuts 53 "point" in the direction of tearing along the tearable line 51.

Figure 14:
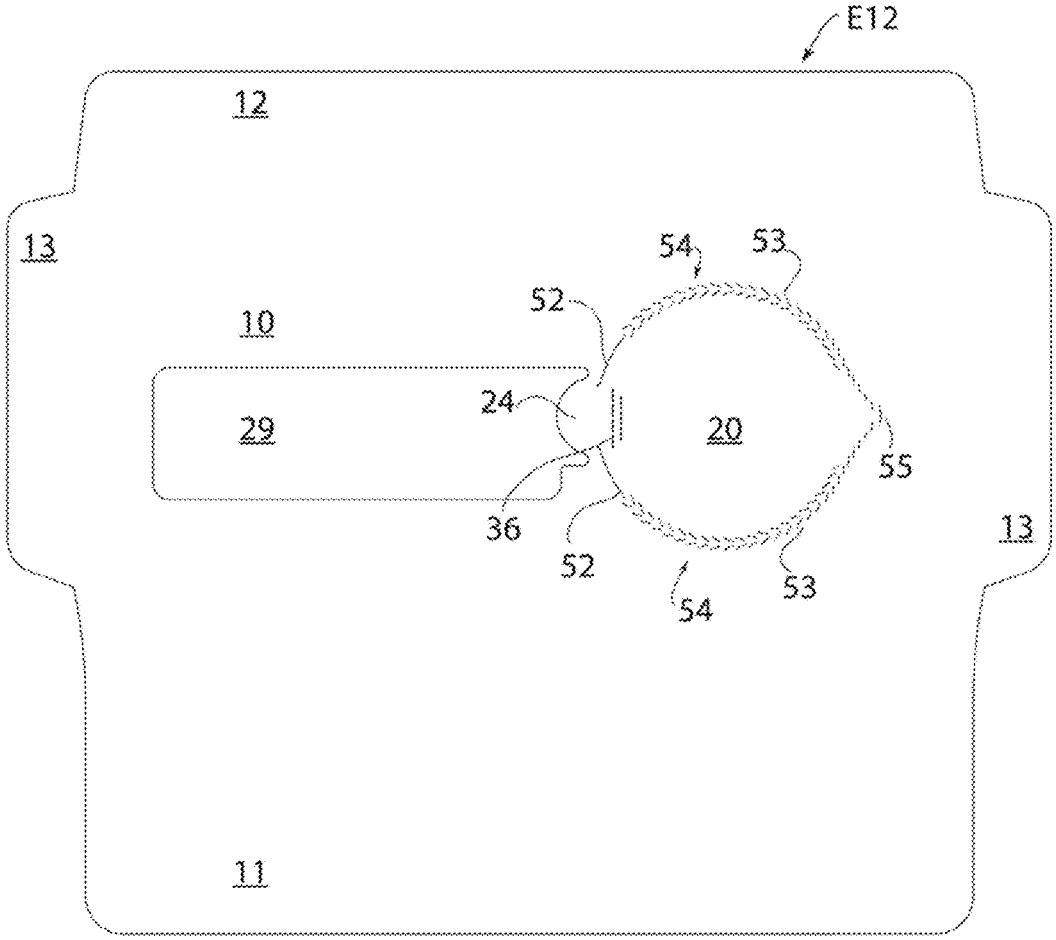
FIG. 14 shows a twelfth embodiment envelope.

FIG. 14 is an outside view of a twelfth embodiment of the invention including a printable sheet material in the form of an envelope E12 that is similar to the envelope E11. However, the separable portion 20 is formed with a generally circular shape and is fully removable. A pair of tearable lines 54 incorporates a combination of the cut lines 52 and the channeling cuts 53 to form the separable portion 20 that extends to a position spaced from the right side flap 13. The cut lines 52 are formed as curved "hockey stick" shapes that curve from the tab 24 toward the back panel 11 and the seal flap 12 respectively. A plurality of the channeling cuts 53 forms two arcuate lines extending from ends of the cut lines 52 toward the right side seal flap 13. A gap between the rightmost ends of the channeling cut lines is bridged by a plurality of overlapping, angled cut lines 55 in a "V" shape pointed toward the right side flap 13.

Figure 15:
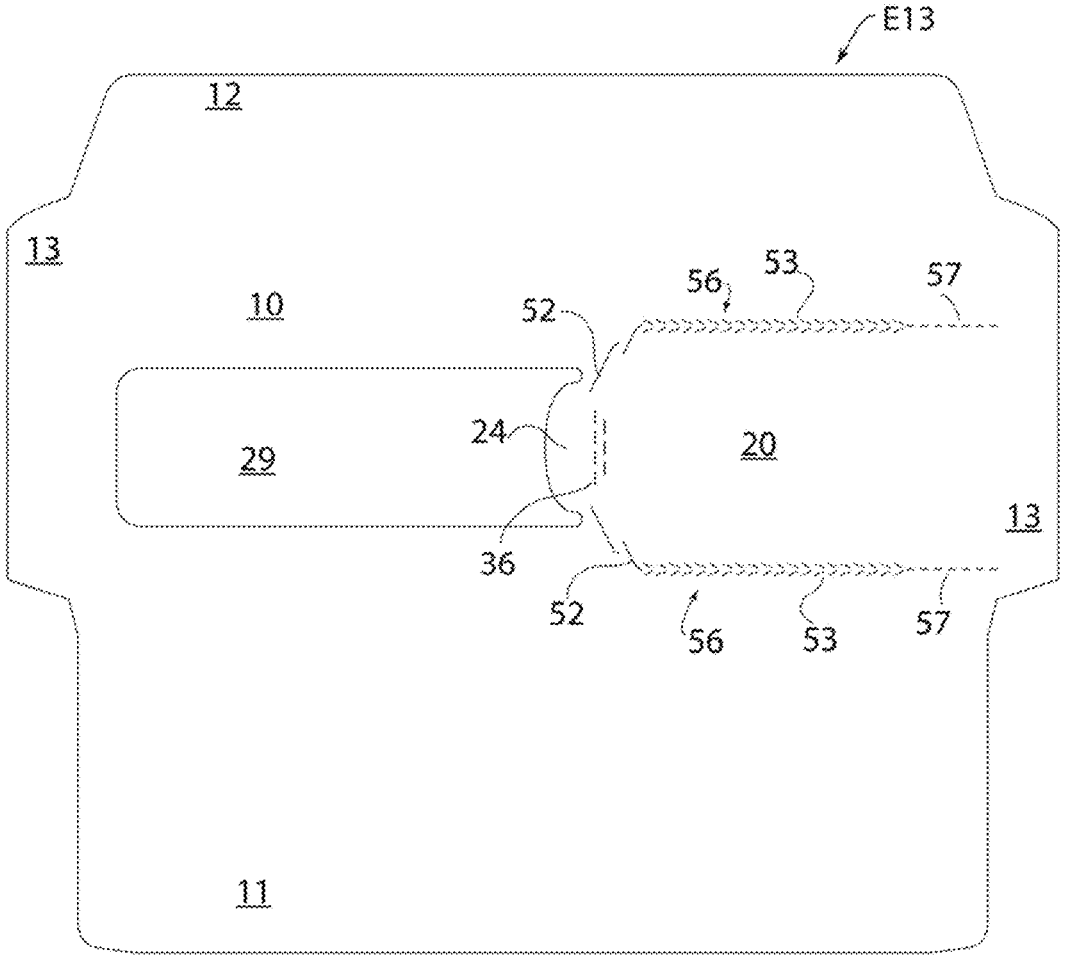
FIG. 15 shows a thirteenth embodiment envelope.

FIG. 15 is an outside view of a thirteenth embodiment of the invention including a printable sheet material in the form of an envelope E13 that is similar to the envelope E11. Also see the envelope E8 shown in FIG. 10. A pair of tearable lines 56 incorporates a combination of the overlapping cut lines 52 adjacent to the tab 24, the straight lines of channeling cuts 53 and a plurality of straight cut lines 57 to form the generally rectangular separable portion 20 that extends to the right side flap 13.

Figure 16:
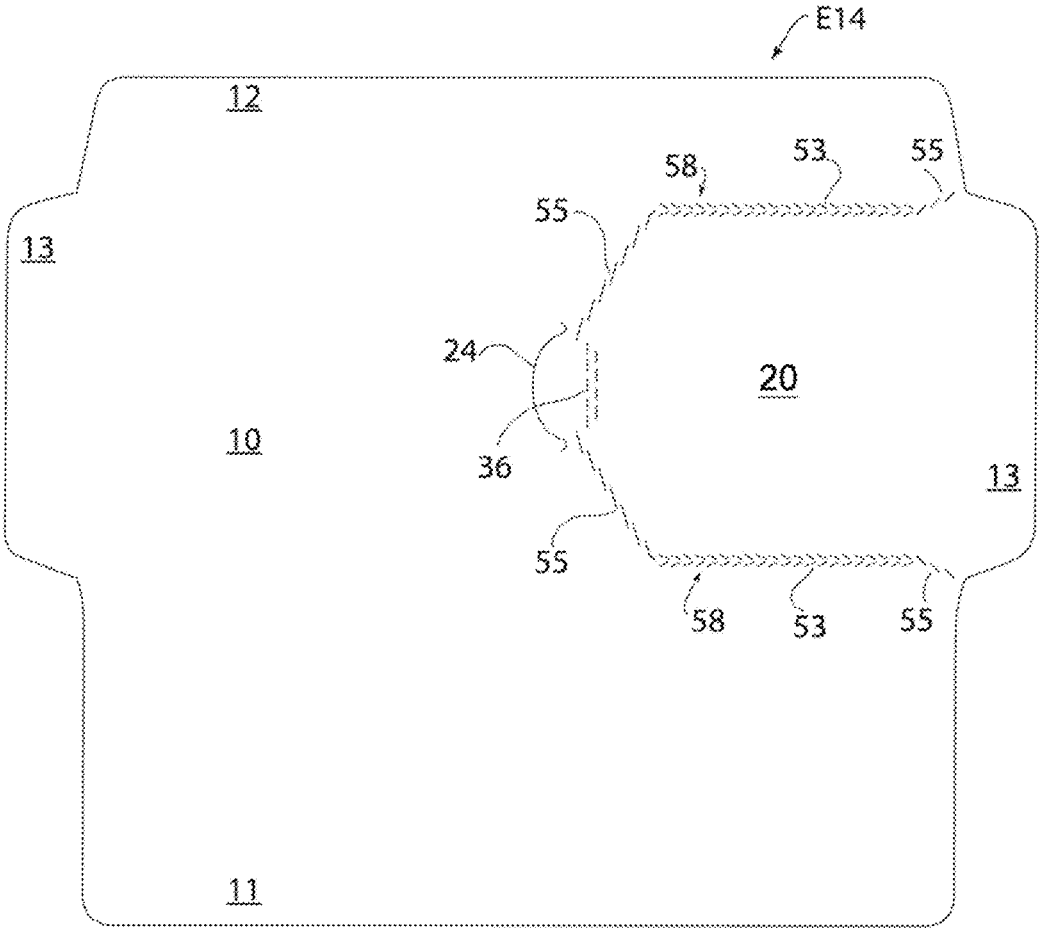
FIG. 16 shows a fourteenth embodiment envelope.

FIG. 16 is an outside view of a fourteenth embodiment of the invention including a printable sheet material in the form of an envelope E14 that is similar to the envelope E13, but does not include the address window 29. Also see the envelope E10 shown in FIG. 12. A pair of tearable lines 58 incorporates a combination of a first set of the overlapping cut lines 55 adjacent to the tab 24, the channeling cuts 53 in straight lines, and a second set of overlapping cut lines 55 to form the generally rectangular separable portion 20. The second set of the cut lines 55 extends from the ends of the lines of channeling cuts 53 to the junctions of the ride side flap 13 with the back panel 11 and the seal flap 12 to render the portion 20 and the side flap 13 fully removable.

Figure 17:
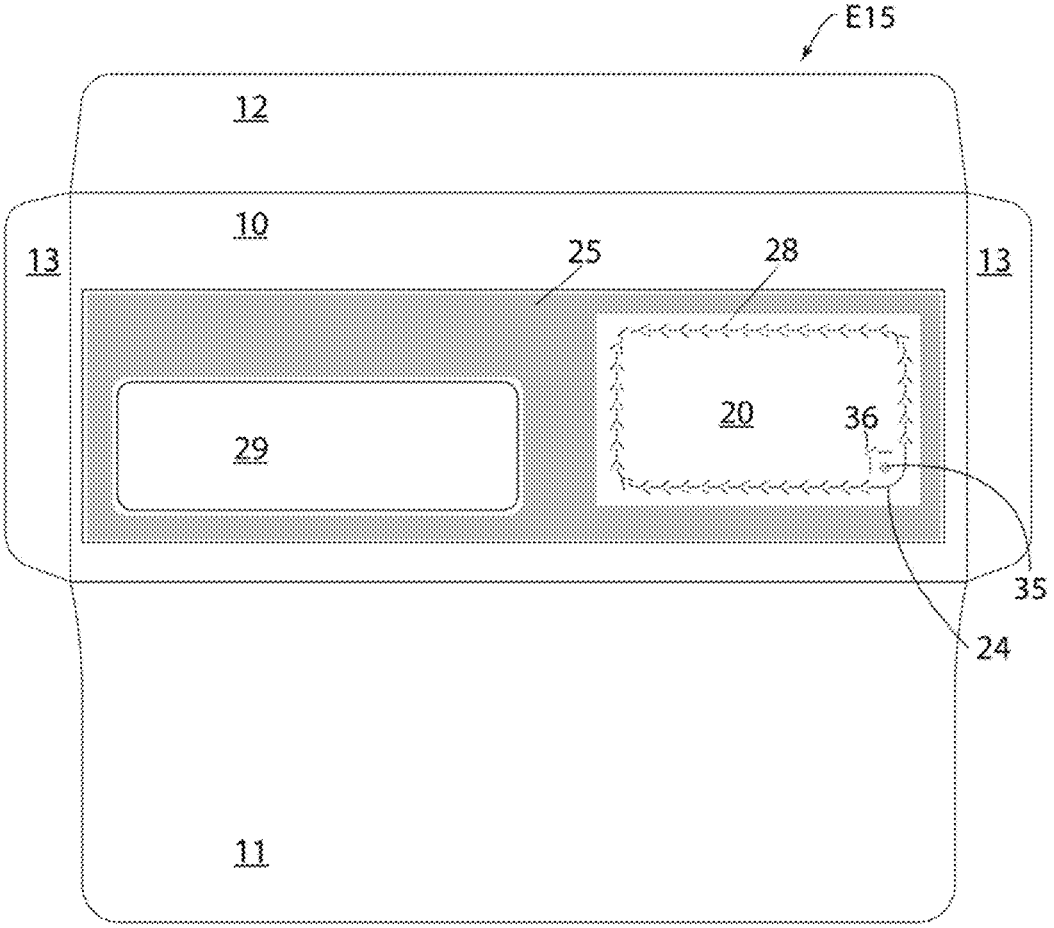
FIG. 17 shows a fifteenth embodiment envelope.

FIG. 17 is an inside view of a fifteenth embodiment of the invention including a printable sheet material in the form of an envelope E15 that is similar to the envelope E5 shown in FIG. 6C, but having a generally rectangular fully separable portion 20. The portion 20 is surrounded by a line of the channeling cuts 28 (see FIG. 8D and cut portions 28*b* and 28*c*) interrupted by the tab 24.

Figure 18:
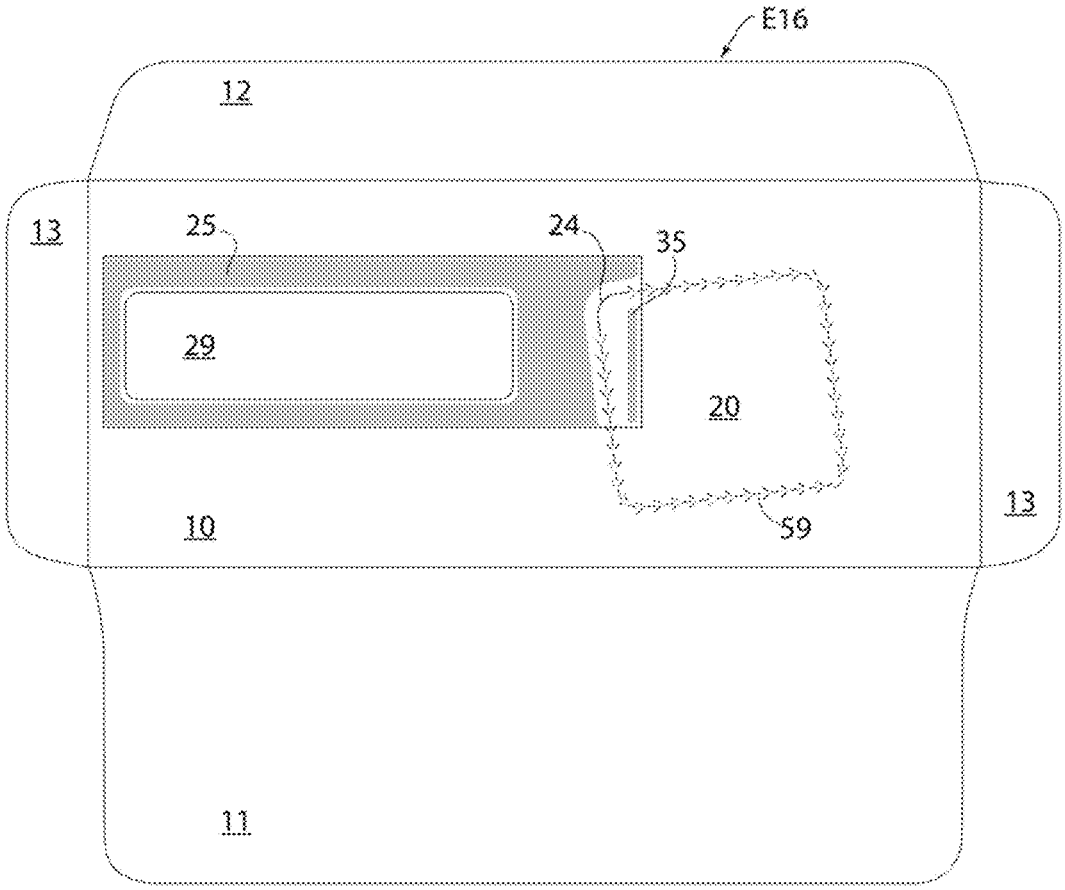
FIG. 18 shows a sixteenth embodiment envelope.

FIG. 18 is an inside view of a sixteenth embodiment of the invention including a printable sheet material in the form of an envelope E16 that is similar to the envelope E15. However, the fully separable portion 20 is in a generally square shape and is tilted so that only a corner forming the tab 24 overlaps a portion of the rectangular area of the attachment device 25 where there is no adhesive. The portion 20 is surrounded by a line of channeling cuts 59 that include open "V" cut lines (see the channeling cuts 53 in FIG. 13) alternating with straight cut lines (see the cut lines 21 in FIG. 8A).

Figure 19:
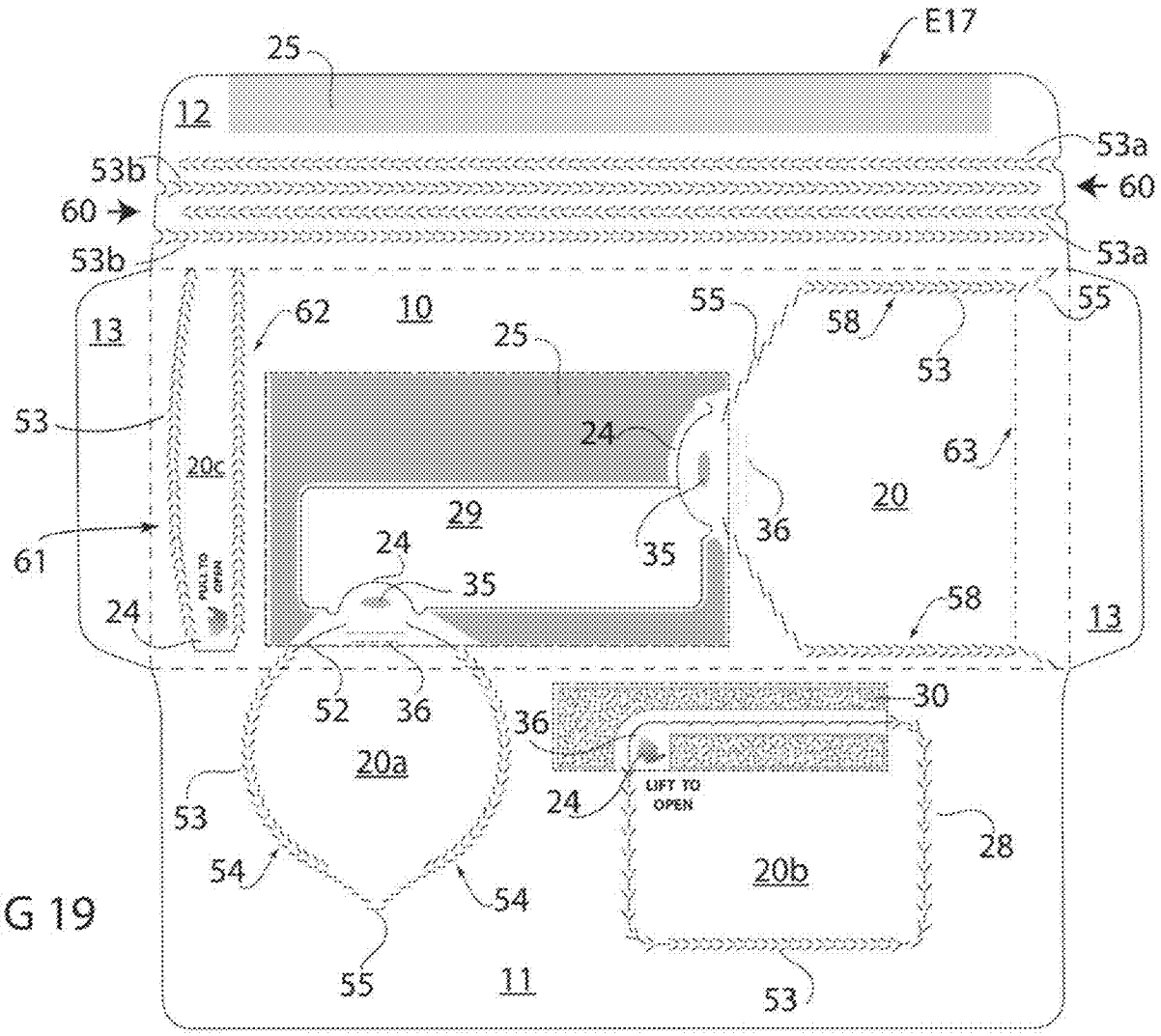
FIG. 19 shows a seventeenth embodiment envelope.

FIG. 19 is an outside view of a seventeenth embodiment of the invention including a printable sheet material in the form of an envelope E17 that incorporates features of the envelopes E1 through E16. On the initial seal flap 12 there is an adhesive area 25 that can be a peel n seal, a pressure seal, a remoisten or a resealable adhesive pattern. The seal flap 12 also includes an open "V" channeling cut tear strip pattern (one or two directions). The open "V" cut pattern (53*a* and 53*b*) within the seal flap panel 12 illustrates a tear strip configuration wherein the tearing can be initiated by pulling a tab shaped structure 60 that is formed on the edge of the seal flap and tearing across the length of the flap along the corresponding linear "V" cut pattern to the opposite edge when the flap is sealed for mailing or internal communications. The two sets of open "V" channeling cut opening tab structures illustrate a two direction opening structure—from left to right using the two parallel tearable lines 53*b* or right to left using the two parallel tearable lines 53*a* at the preference of the recipient. This is a very unique structure with the open "V" channeling cut lines. The only other two directional opening strip structure on the market includes a reinforced nylon string which is used to rip through the flap in line with the string pattern which applied in only a straight pattern. Most of this type of containers (e.g., UPS and FedEx envelope packages) are made using multiple layered thicker paperboard materials. The top surface or layer of this type of packaging may also include a kiss cut line to assist the opening but the hot melt string pattern actually rips through the lower layer of the paperboard material.

An open "V" channeling cut separable portion tear strip 20*c* is formed on the left side of the front panel 10. This structure illustrates a tearable open "V" cut 53 pattern that does not require a patch behind the opening thumb cut tab shape 24 at the bottom. This design has a curved tearable line 61 pattern and a straight tearable line 62 pattern to illustrate that the tearable lines can follow any pattern, shape or image, etc. The tear strip 20*c* provides access to the contents of the envelope by simply lifting and pulling the tab 24 which rips along the open "V" channeling cut patterns 61 and 62. The opening tab shape can be modified to open along the bottom edge as illustrated or just along one corner edge like the removable rectangular pattern 20*b* on the back panel 11.

The tabbed opening structure 20 on the right side of the front panel 10 with open "V" channeling cuts 53 at top and bottom features a tab shaped starting mechanism 24 that is described in U.S. Pat. No. 6,983,875 (can include the affixation point or glue spot 35 and the release cuts 36), and opening structure of U.S. Pat. No. 8,020,751, but integrates open "V" channeling cuts along the top and bottom edges. The starting mechanism 24 overlaps a portion of a rectangular area of the attachment device 25 where there is no adhesive. The open "V" channeling cuts 53 along the top and bottom of the opening structure could be utilized in the part of the opening that angles towards the top and bottom of the right side flap 13. A third tearable line 63 allows the left portion of the opening structure 20 to be detached along the tearable line after it is initially opened. The address window 29 is included in the front panel 10 and extends behind and around the initial opening tab structure 24. The opening tab structure 24 could be modified with an opening structure that does not require patch material similar to the opening tear strip structure 20*c* on the left side of the front panel 10.

The tabbed opening structure 20*a* in the middle of the address window 29 on the front panel 10 with the open "V" channeling cuts 53 in a rounded pattern opens downwardly across a fold line where the opening shape continues on the back panel 11. It features a tab shaped opening mechanism 24 within the address window 29 that is described in U.S. Pat. No. 6,983,875 (glue spot and release cuts), and the opening structure in U.S. Pat. No. 8,020,751, but integrates open "V" channeling cuts along the left and right edges of the round shaped opening structure across the front and back panel where it is designed to be detachable when it is fully opened. The address window 29 included in the front panel 10 extends behind and around the initial opening tab structure 24. The opening tab structure 24 could be modified with an opening structure that does not require patch material similar to the opening tear strip structure 20*c* formed on the left side of the front panel 10.

The rectangular opening structure 20*b* with a patch 30 having a repositionable adhesive area on the right side of the back panel 11 is formed with the open "V" channeling cuts 53 along a lower tearable perimeter line. The separable portion 20*b* features a rounded corner shaped opening mechanism 24. The open "V" channeling cuts 53 are only along the bottom of the opening structure 20*b*, but the open "V" cuts could be utilized in the other perimeter tear lines formed by the channeling cuts 28. This illustration shows one configuration of an opening structure that includes a patch 30 which is positioned along the two upper edges that form the easy opening rounded corner shape. The patch 30 is not required for the opening structure 20*b*, but is included to illustrate a removable shape that could be opened, removed and subsequently be re-attached to another area of this container or second object or structure using a lifted patch and repositionable adhesive. The patch 30 (when desired) would only need to cross one edge of this particular opening structure even though it is shown crossing two edges. The patch 30 and corresponding repositionable adhesive area needs only to extend enough into the removable shaped structure 20*b* so as to enable reattachment as desired. It could be as small as ⅛" thick depending on the length or width of the detachable portion and the partial patch. The repositionable adhesive is illustrated as a pattern that stops short of the opening structure cut pattern but is applied light enough to be a continuous pattern crossing from outside the opening shape 20*b* to the area inside the opening shape.

In summary, the pair of tearable lines 58 forms the generally rectangular first separable portion 20, similar to FIG. 16, extending from the address window 29 to the right side flap 13. The pair of tearable lines 54 forms the generally circular second separable portion 20*a*, similar to FIG. 14, extending from the address window 29 across a fold line and into the back panel 11. The generally rectangular third separable portion 20*b*, similar to FIG. 17, is formed in the back panel 11. The generally rectangular fourth separable portion 20*c* is formed in the front panel 10.

Figure 20:
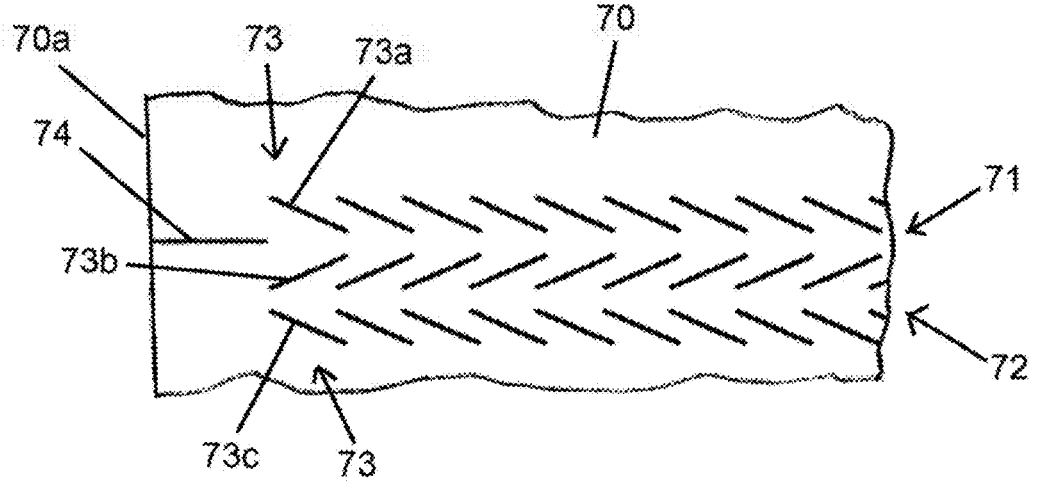
FIG. 20 shows two tearable lines sharing converging cuts according to the invention.

The adjacent open "V" cut pattern tearable lines 53*a* and 53*b* shown in FIG. 19 can be configured to reduce the number of cuts required to achieve a two direction opening structure. FIG. 20 is an enlarged view of a portion of two tearable lines 71 and 72 each formed from a plurality of open "V" channeling cuts 73 in a sheet material 70. Each channeling cut 73 is formed in the open "V" shape by a pair of converging cuts spaced wider apart at one end than at an opposite end. The channeling cuts 73 are spaced apart along the tearable lines 71 and 72 extending in a straight line path in the horizontal direction. Each of the channeling cuts 73 in the first tearable line 71 is formed by a first converging cut line 73*a* spaced above a second converging cut line 73*b*. The channeling cuts 73 forming the first tearable line 71 are oriented to facilitate tearing from left to right. A starting mechanism in the form of a cut line 74 in the sheet material 70 is positioned at the left end of the tearable line 71 adjacent to the first channeling cut 73. The starting cut line 74 extends from an edge 70*a* of the sheet material 70 in a direction of a longitudinal axis of the first tearable line 71.

Each of the channeling cuts 73 in the second tearable line 72 is formed by a third converging cut line 73*c* spaced below an associated one of the second converging cut lines 73*b*. The channeling cuts 73 forming the second tearable line 72 are oriented to facilitate tearing from right to left. A starting mechanism in the form of the cut line 74 can be positioned at the left end (not shown) of the second tearable line 72. By sharing the converging cut lines 73*b*, the number of converging cut lines is reduced by 25% and the tearable lines 71 and 72 are closer together as compared with the tearable lines 53*a* and 53*b* shown in FIG. 19.

Figure 21:
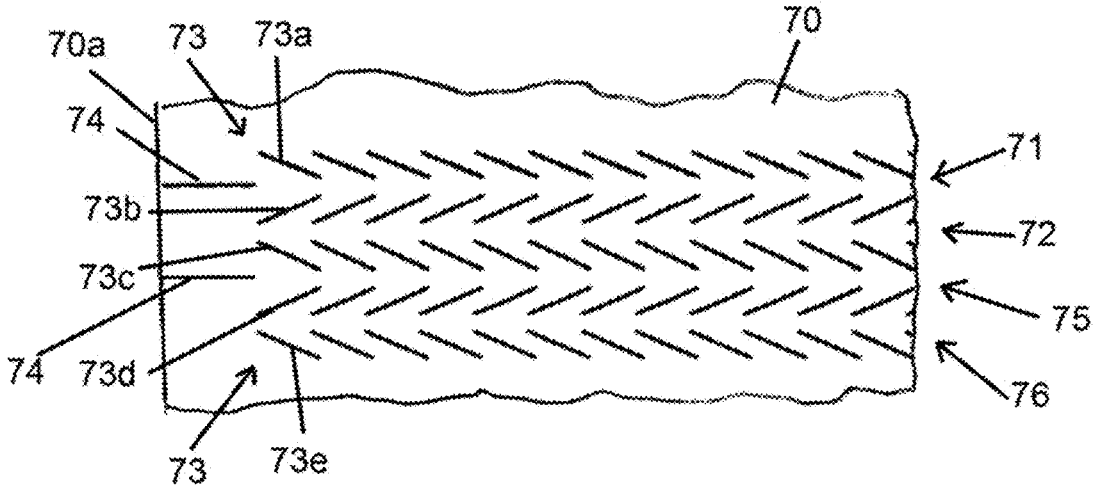
FIG. 21 shows four tearable lines sharing converging cuts according to the invention.

FIG. 19 shows two sets of the open "V" cut pattern tearable lines 53*a* and 53*b* resulting in four separate tearable lines. These lines can be configured to reduce the number of cuts required to achieve a two direction opening structure. FIG. 21 is an enlarged view of a portion of four tearable lines 71, 72, 75 and 76 each formed from a plurality of the open "V" channeling cuts 73 in the sheet material 70. Each of the channeling cuts 73 in the third tearable line 75 is formed by one of the third converging cut lines 73*c* spaced above a fourth converging cut line 73*d*. The channeling cuts 73 forming the third tearable line 75 are oriented to facilitate tearing from left to right. A starting mechanism in the form of the cut line 74 is positioned at the left end of the tearable line 75 adjacent to the first channeling cut 73.

Each of the channeling cuts 73 in the fourth tearable line 76 is formed by a fifth converging cut line 73*e* spaced below an associated one of the fourth converging cut lines 73*d*. The channeling cuts 73 forming the fourth tearable line 76 are oriented to facilitate tearing from right to left. A starting mechanism in the form of the cut line 74 can be positioned at the left end (not shown) of the fourth tearable line 76. By sharing the converging cut lines 73*b*, 73*c* and 73*d*, the number of converging cut lines is reduced by 37.5% and the tearable lines 71, 72, 75 and 76 are closer together as compared with the tearable lines 53*a* and 53*b* shown in FIG. 19.

Figure 22A:
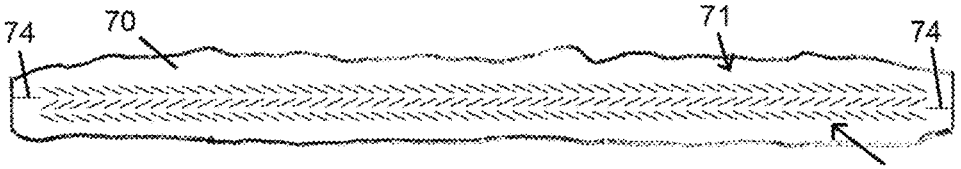
FIGS. 22A-22E are illustrations of various tearable line configurations sharing converging cuts according to the invention.
Figure 22B:
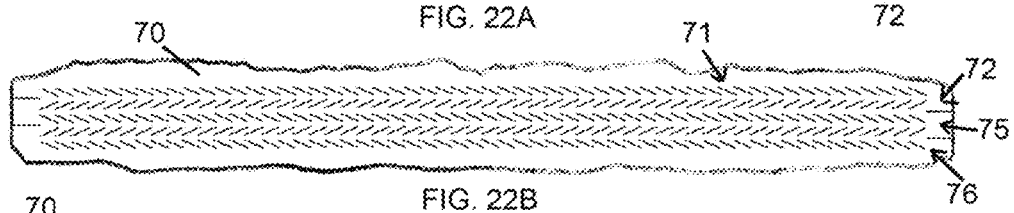

FIGS. 22A-22E are illustrations of various tearable line configurations incorporating the channeling cut orientations shown in FIGS. 20 and 21. FIG. 22A corresponds to FIG. 20 wherein the entire length of each of the tearable lines 71 and 72 is shown as well as the starting cut line 74 for each tearable line. In a similar manner, FIG. 22B corresponds to FIG. 21 wherein the entire length of each of the tearable lines 71, 72, 75 and 76 is shown as well as the starting cut line 74 for each tearable line.

Figure 22C:
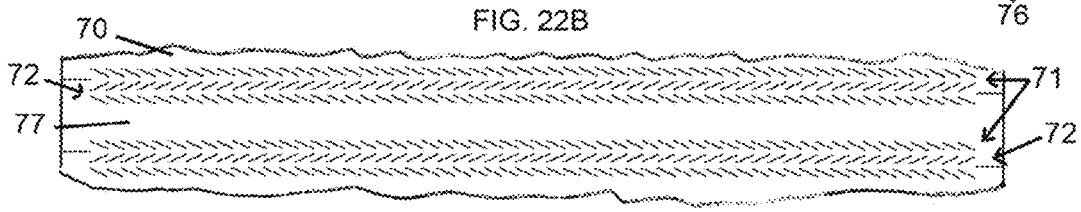
Figure 22D:
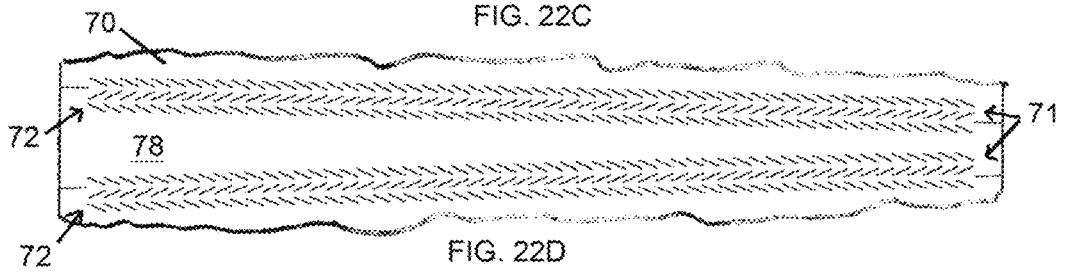

FIG. 22C shows two sets of the tearable lines 71 and 72 spaced apart by a portion 77 of the sheet material 70. FIG. 22D also shows two sets of the tearable lines 71 and 72 spaced apart by a portion 78 of the sheet material 70. However, the upper and lower sets of tearable lines extend along paths angled relative to one another being closer together at the right end than at the left end. Thus, the opening in the sheet material 70 either widens when the tearing of the portion 78 moves from right to left, or narrows when the tearing moves from left to right.

Figure 22E:
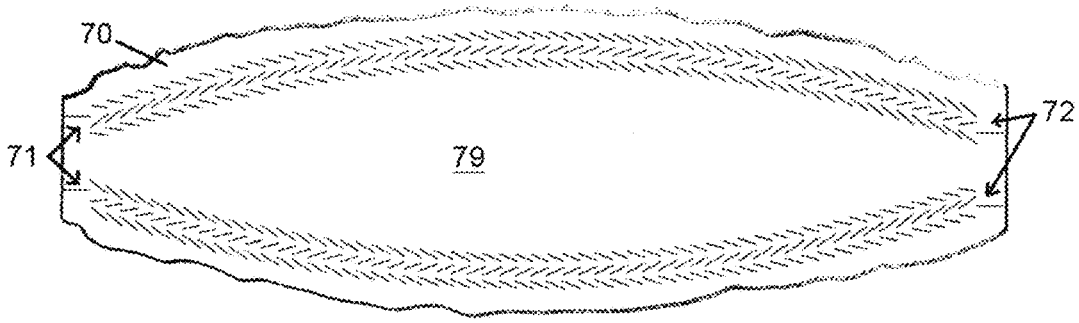

FIG. 22E shows two sets of the tearable lines 71 and 72 spaced apart by a portion 79 of the sheet material 70. The tearable lines 71 and 72 extend along curved paths to form the portion 79 into a generally oval shape. The tearable lines 71, 72, 75 and 76 shown in FIG. 22B also can be curved. Further, the tearable lines shown in FIGS. 22A and 22B can be formed along any path to create a desired opening or tearing shape.

The printable sheet materials E1 through E17 have an opening structure comprising: a face or front panel having an integral separable portion; a tearable line formed in the front panel permitting the separable portion to be at least partially separated from a remaining portion of the front panel, the tearable line including a plurality of cut lines separated by a plurality of connectors and, in some cases, channeling cuts; and, in some cases, a patch positioned behind the separable portion whereby when the separable portion is detached from the front panel along the tearable line, the patch is exposed.

It should be understood that all of the illustrated embodiments and the above descriptions of any components and features may be adjusted or modified for any application, desired size, material construction, configuration, form and quantity, as is or becomes known. The invention is in no way limited to the components, configurations, dimensions, specific example or other details described above or shown in the attached figures. Further, the above-described features are not limited to the details as described and shown. Yet further, each such feature can be used independently of any other feature. Moreover, the invention does not require each of the above features and includes further capabilities, functions, methods, uses and applications, as will be apparent to a person skilled in the art based upon the description above and the appended drawings and claims. Thus, the particular combination of inventive features described herein and shown in the appended drawings is not limiting on the invention. While preferred embodiments of the invention have been shown and described, modifications thereof can be made by one skilled in the art without departing from the spirit or teachings of this invention. Many variations and modifications of the invention are possible and are within the scope of the invention. Accordingly, the scope of protection is not limited to the embodiments described herein.

In accordance with the provisions of the patent statutes, the invention has been described in what is considered to represent its preferred embodiment. However, it should be noted that the invention can be practiced otherwise than as specifically illustrated and described without departing from its spirit or scope.

What is claimed is:

1. A printable sheet material having an opening structure comprising:

a panel having an integral separable portion;

a plurality of tearable lines forming an edge of the separable portion, the tearable lines permitting the separable portion to be at least partially separated from a remaining portion of the panel, each of the tearable lines including a plurality of open "V" channeling cuts, the channeling cuts being spaced apart along the tearable lines separated only by solid area connectors;

a first tearable line of the plurality of tearable lines having each of the channeling cuts included therein formed by a first converging cut and a second converging cut, the first converging cut and the second converging cut directed toward a single point on the first tearable line;

a second tearable line of the plurality of tearable lines having each of the channeling cuts included therein formed by a third converging cut and the second converging cut of an adjacent one of the channeling cuts of the first tearable line, the third converging cut and the second converging cut directed toward a single point on the second tearable line; and a third tearable line of the plurality of tearable lines having each of the channeling cuts included therein formed by a fourth converging cut and the third converging cut of an adjacent one of the channeling cuts of the second tearable line, wherein each of the channeling cuts included in the tearable lines has a wider spaced end and a narrower spaced end, wherein the channeling cuts of the first and third tearable lines are oriented with the wider spaced ends facing toward a start of a first tearing direction, and wherein the channeling cuts of the second tearable line are oriented with wider spaced ends facing toward a start of a second tearing direction being opposite the first tearing direction; and a starting mechanism formed in the panel wherein the wider spaced ends of the channeling cuts face toward the starting mechanism, the starting mechanism including three starting cuts each positioned adjacent an end of an associated one of the tearable lines.

2. The sheet material according to claim 1 wherein the first tearable line, the second tearable line and the third tearable line extend along at least one of a straight path, an angled path and a curved path.

3. The sheet material according to claim 1 wherein the first tearable line, the second tearable line and the third tearable line extend along respective paths and at least one other tearable line is formed in the panel spaced apart from or intersecting with at least one of the first, second and third tearable lines.

4. The sheet material according to claim 1 including a fourth tearable line of the plurality of tearable lines having each of the channeling cuts included therein formed by a fifth converging cut and the fourth converging cut of an adjacent one of the channeling cuts of the third tearable line, wherein each of the channeling cuts included in the fourth tearable line has a wider spaced end and a narrower spaced end, the channeling cuts being oriented with the wider spaced ends facing toward the start of the second tearing direction.

5. The sheet material according to claim 4 wherein the first tearable line, the second tearable line, the third tearable line and the fourth tearable line extend along at least one of a straight path, an angled path and a curved path.

6. The sheet material according to claim 4 wherein the first tearable line, the second tearable line, the third tearable line and the fourth tearable line extend along respective paths and at least one other tearable line is formed in the panel spaced apart from or intersecting with at least one of the first, second, third and fourth tearable lines.

* * * * *